US006970399B2

(12) United States Patent
Watanabe et al.

(10) Patent No.: US 6,970,399 B2
(45) Date of Patent: Nov. 29, 2005

(54) THERMAL POWER GENERATING TIMEPIECE AND REAR COVER FOR THERMAL POWER GENERATING TIMEPIECE

(75) Inventors: Shigeru Watanabe, Iruma (JP); Atsushi Murakami, Tokyo (JP); Yumiko Sakamaki, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 385 days.

(21) Appl. No.: 10/030,166

(22) PCT Filed: May 31, 2001

(86) PCT No.: PCT/JP01/04591

§ 371 (c)(1),
(2), (4) Date: Jan. 30, 2002

(87) PCT Pub. No.: WO01/92969

PCT Pub. Date: Dec. 6, 2001

(65) Prior Publication Data

US 2003/0007424 A1 Jan. 9, 2003

(30) Foreign Application Priority Data

May 31, 2000 (JP) ..... 2000-161400
Aug. 17, 2000 (JP) ..... 2000-247269

(51) Int. Cl.[7] ..... G04C 3/00; G04B 37/00

(52) U.S. Cl. ..... 368/204; 368/88; 368/276

(58) Field of Search ..... 368/203–204, 368/64, 88, 276, 281; 136/242, 205, 211, 136/212

(56) References Cited

U.S. PATENT DOCUMENTS

| | | | | |
|---|---|---|---|---|
| 4,106,279 | A * | 8/1978 | Martin et al. | 368/64 |
| 4,213,292 | A * | 7/1980 | Dolezal et al. | 368/204 |
| 5,889,735 | A * | 3/1999 | Kawata et al. | 368/64 |
| 5,974,002 | A * | 10/1999 | Tsubata | 368/64 |
| 6,075,757 | A * | 6/2000 | Kawata | 368/204 |
| 6,222,114 | B1 * | 4/2001 | Mitamura | 136/242 |
| 6,359,841 | B1 * | 3/2002 | Kotanagi et al. | 368/203 |
| 6,407,965 | B1 * | 6/2002 | Matoge et al. | 368/204 |
| 6,426,921 | B1 * | 7/2002 | Mitamura | 368/204 |

(Continued)

FOREIGN PATENT DOCUMENTS

JP 55-20483 2/1980

(Continued)

*Primary Examiner*—Randy Gibson
*Assistant Examiner*—Jeanne-Marguerite Goodwin
(74) *Attorney, Agent, or Firm*—Westerman, Hattori, Daniels & Adrian, LLP

(57) ABSTRACT

A thermoelectric power generating timepiece (1) comprises a dial (30), a movement (40), and a heat conduction sheet (50), provided within an enclosed space, defined by a case (10) made of metal, with a glass (20) fixedly attached thereto, and a case back (70), and further comprises a thermoelectric element (60), housed in a gap between the heat conduction sheet (50) and the case back (70). The case back 70 is made of two kinds of materials each having a thermal conductivity differing from that of the other. The case back (70) is made up of a heat conducting part (71) made of material, such as metal, and the like, having a high thermal conductivity, and formed in a shape larger in outer size than the thermoelectric element (60), so as to be disposed opposite to the thermoelectric element (60), and a heat insulating part (72) made of material having a low thermal conductivity such as plastics, and the like, and formed so as to be disposed on the outside of the heat conducting part (71).

16 Claims, 13 Drawing Sheets

U.S. PATENT DOCUMENTS 6,560,167 B1 * 5/2003 Kotanagi ..... 368/203

FOREIGN PATENT DOCUMENTS

| | | |
|---|---|---|
| JP | 55-40333 | 3/1980 |
| JP | 58-50489 | 3/1983 |
| JP | 5-196750 | 8/1993 |
| JP | 5-223957 | 9/1993 |
| JP | 7-32590 | 6/1995 |
| JP | 2946205 | 7/1999 |
| JP | 2998088 | 11/1999 |

* cited by examiner

THERMAL POWER GENERATING TIMEPIECE AND REAR COVER FOR THERMAL POWER GENERATING TIMEPIECE

TECHNICAL FIELD

The present invention relates to a thermoelectric power generating timepiece utilizing a thermoelectric element made up of a plurality of thermocouples as a power supply source thereof, and a case back for the same.

BACKGROUND TECHNOLOGY

There has been seen progress in microminiaturization of electronic components making use of various kinds of metallic materials from year to year. Typical examples of the electronic components include a thermoelectric element. In the thermoelectric element, a voltage is developed when different temperatures are applied to the opposite ends thereof. In thermoelectric power generation, such a voltage as developed is utilized as electric energy. The thermoelectric element for use in thermoelectric power generation has the advantage of being more suitable for microminiaturization than other generators and power generation elements because of its simple construction, and further it does not pose a problem of depletion of electric power or leakage of an eletrolyte as with the case of an oxidation-reduction battery. Accordingly, it has attracted much attention owing to its potential for application as a power supply source of a portable electronic equipment such as an electronic timepiece.

Meanwhile, there has recently been a tendency that product development is carried out based on the precondition that environmental problems have been fully taken into consideration. In the case of the portable electronic equipment, a button type silver cell and lithium cell are in use as a power supply source in order to render the portable electronic equipment miniaturized and lower in profile. If these cells are replaced as a result of depletion of electric power, and are discarded afterward, there is no denying a possibility that this will cause environmental pollution. For this reason, it has been highly desired that development of a portable electronic equipment without the need for replacement of its cell becomes a reality, and to that end, the thermoelectric element is regarded as an element to play an important role.

With the thermoelectric element, a plurality of thermocouples each comprised of a p-type thermoelectric semiconductor and an n-type thermoelectric semiconductor are arranged in series, and a thermoelectric timepiece which is a wrist watch employing the thermoelectric element as a power supply source thereof has been well known. With a conventional thermoelectric power generating timepiece, even if an outside-air temperature is 25° C., and a skin temperature of an arm wearing the same is 32° C. by way of example, thereby causing a difference of 7° C. between both the temperatures, it has been possible to obtain a difference in temperature, only on the order of 1.3° C., between a cold junction and a hot junction of the thermoelectric element. Accordingly, there has been obtained a thermal electromotive force of about 400 $\mu$V/° C. per thermocouple, and even if 2000 Bi—Te based thermocouples, regarded as a thermocouple having high performance, are connected in series, a thermal electromotive force on the order of 1V only can be obtained, so that there has been the need for connecting as many of the thermocouples as possible. Furthermore, since the thermoelectric element needs to be housed in a limited space inside a timepiece, microminiaturization as well as high densification thereof is unavoidable so as to be able to obtain a high thermal electromotive force from the same small in size, however, there are limitations to the microminiaturization and the high densification. Accordingly, there has emerged the need for increasing a difference in temperature between the cold junction and the hot junction of the thermocouples in order to obtain a high thermal electromotive force therefrom, and in order to implement this, it has become necessary to introduce a new design idea to the construction of a thermoelectric power generating timepiece.

Now, the construction of a conventional thermoelectric power generating timepiece is specifically described hereinafter. FIG. 20 is a sectional view showing the conventional thermoelectric power generating timepiece 200. With the thermoelectric power generating timepiece 200, there are provided a dial 30, a movement 40, a heat conduction sheet 50, and a thermoelectric element 60, installed inside an air-tight main body of the timepiece, made up of a case 15 made of metal, with a glass 20 fixedly attached thereto, heat insulating cases 180, and a case back 185, and a difference in temperature, occurring between the case back 185 and the case 15, is converted into electric energy, thereby providing a power supply source for driving the timepiece.

The thermoelectric element 60 is disposed so as to cause one face thereof to be in contact with the case back 185 with a lower protection sheet 62 interposed therebetween, and to cause the other face thereof to be in contact with the heat conduction sheet 50 with an upper protection sheet 61 interposed therebetween. The heat conduction sheet 50 is disposed between the movement 40 and the upper protection sheet 61 such that both ends thereof are in contact with the case 15.

When the thermoelectric power generating timepiece 200 is worn on the arm of a user, the case back 185 is warmed by body heat of the user, and the case 15 is cooled by the effect of an outside-air temperature. Hereupon, direct conduction of heat from the case back 185 towards the case 15 is blocked by the heat insulating case 180 made of plastics and the like, so that the case back 185 is on a high temperature side while the case 15 is on a low temperature side. Since conduction of heat from the case back 185 to the thermoelectric element 60 occurs via the lower protection sheet 62, and conduction of heat from the case 15 to the thermoelectric element 60 occurs via the heat conduction sheet 50 and the upper protection sheet 61, the underside face of the thermoelectric element 60 becomes a hot junction and the upper face thereof becomes a cold junction, so that the thermoelectric element 60 is provided with a difference in temperature. The difference in temperature is converted into a voltage, and electric power is supplied to the movement 40, thereby activating the thermoelectric power generating timepiece 200.

In this connection, conversion of the difference in temperature, given to the thermoelectric element 60, into the voltage is attributable to the Seebeck effect of thermocouples incorporated in the thermoelectric element 60. Since the voltage obtained by the agency of the thermocouples is a function of the Seebeck coefficient and the difference in temperature, it is necessary to provide the thermoelectric element 60 with as much difference in temperature as possible in order to increase the magnitude of a thermal electromotive force, thereby stably driving the thermoelec tric power generating timepiece 200. Accordingly, with the thermoelectric power generating timepiece 200, it is a very important factor to increase the difference in temperature between the case back 185 and the case 15.

A conceivable method of increasing the difference in temperature within the thermoelectric power generating timepiece is to control conduction of heat from the case back 185 to the case 15 by reducing heat conduction through the heat insulating cases 180 as much as possible. Since an amount of heat conducted through a member is generally proportional to a value found by the formula $(Q \times S)/L$ where Q=thermal conductivity of the constituent material of the member, S= a sectional area of the member, and L=length of the member, reduction in the thermal conductivity of the constituent material will suffice for controlling conduction of heat.

Plastics having a low thermal conductivity is generally used as the constituent material of the heat insulating cases 180, however, material having a thermal conductivity lower than that of plastics, and yet suited for construction of the heat insulating cases 180 has been unavailable.

It is also conceivable to reduce the sectional area of the heat insulating cases 180 by narrowing down a width thereof, in a radial direction thereof. However, if the width of the heat insulating cases 180 made of plastics is narrowed down, this will raise a problem in respect of its strength, and further, the width thereof wider than a given size needs to be maintained so as to enable the case back 185 to be secured thereto with screws. A concept of reducing the sectional area of the heat insulating cases 180 is therefore not appropriate.

Still further, it is conceivable to increase a length of the heat insulating cases 180, in the direction of the axis thereof. Even if the length of the heat insulating cases 180 is increased, however, a sufficient distance needs to be provided between heat absorbing portions thereof, and heat radiating portions thereof, so that a distance between the heat conduction sheet 50 and the case back 185 needs to be rendered longer, whereupon the thickness of the thermoelectric power generating timepiece 200 in whole is excessively increased. In addition, the dimensions of the thermoelectric element 60 needs to be changed in proportion as the distance between the heat conduction sheet 50 and the case back 185 is increased. Such change in the dimensions will result in change in the characteristics of the thermoelectric element 60 as well, rendering it impossible to operate the thermoelectric element 60 in an optimum condition.

Thus, with the conventional thermoelectric power generating timepiece 200, it has been difficult to improve the thermal electromotive force by introducing a new design idea to the construction of the heat insulating cases 180 such that the difference in temperature, given to the thermoelectric element 60, is increased. Accordingly, in order to implement an increase in the thermal electromotive force, there has been no choice but to enlarge the timepiece in whole, thereby raising efficiency of heat radiation of the case 15.

Meanwhile, in order to increase the difference in temperature, given to the thermoelectric element 60, it is also important to construct the thermoelectric power generating timepiece 200 such that an inner structure thereof is suited for enhancing heat conduction efficiency.

An important precondition for enhancing the heat conduction efficiency is that the case back 185 and the thermoelectric element 60 are securely in contact with each other at the hot junction therebetween, and the case 15 and the thermoelectric element 60 are securely in contact with each other at the cold junction therebetween, thereby ensuring occurrence of heat conduction with small loss in heat. Means for ensuring conduction of heat from a thermoelectric element to a case are disclosed in, for example, JP-2998088, B. The means represent a method whereby a heat conductor is disposed on an upper face of a second heat conduction sheet in contact with a cold junction of a thermoelectric power generation unit comprising a thermoelectric element, and according to the method, there occurs a flow of heat conduction from the thermoelectric power generation unit to a case via the second heat conduction sheet and the heat conductor, thereby enabling the case to fulfill the role of a heat radiation case. In this case, however, since the heat conductor is disposed so as to overlie the second heat conduction plate, the thickness of a timepiece in whole is affected to the extent of the thickness of the heat conductor.

Furthermore, because of an empty space existing between a movement and the heat conductor, the thickness of the timepiece is increased to the extent of the empty space. In addition, this arrangement will not allow dissipation of heat through conduction thereof from the heat conductor to the movement, thereby deteriorating heat conduction efficiency.

Thus, there has been recognized the need for introducing a novel design idea to the construction of a thermoelectric power generating timepiece such that heat conduction efficiency can be enhanced without causing adverse effects as much as possible on the external appearance of a timepiece, such as the thickness thereof, and so forth.

The present invention has been developed to solve the problems as described above, and an object of the invention is to provide a thermoelectric power generating timepiece provided with a thermoelectric element as a power supply source, wherein a sufficient thermal electromotive force is obtained by securing a large difference in temperature, given to the thermoelectric element, without adversely affecting the external appearance of the timepiece in whole while keeping the thickness thereof substantially the same as that of the conventional thermoelectric power generating timepiece, thereby enhancing performances thereof.

DISCLOSURE OF THE INVENTION

A thermoelectric power generating timepiece according to the invention comprises a dial, a movement, and a heat conduction sheet, installed within a hermetically enclosed space, defined by a case made of metal with a glass fixedly attached thereto, and a case back, further comprising a thermoelectric element for serving as a power supply source of the movement, housed in a gap between the heat conduction sheet and the case back, wherein the case back is made of not less than two kinds of constituent materials each having a different thermal conductivity.

With the thermoelectric power generating timepiece, efficient conduction of heat from the arm of a user to the thermoelectric element can occur by the agency of a constituent material of the case back, having a high thermal conductivity, while conduction of heat to the case made of metal can be blocked by the agency of a constituent material of the case back, having a low thermal conductivity, so that a large difference in temperature can be given to the thermoelectric element.

Further, the case back preferably comprises a heat conducting part having a high thermal conductivity, formed in a shape larger in outer size than the thermoelectric element, and disposed opposite to the thermoelectric element, and a heat insulating part having a low thermal conductivity, formed so as to be disposed on the outside of the heat conducting part.

The heat conducting part of the case back is preferably made of a metallic material, and the heat insulating part thereof is preferably made of plastics or ceramics.

The case back may be formed of the metallic material and the plastics by the insert molding method.

The case back may be formed by uniting the heat conducting part with the heat insulating part by securing both parts together with screws.

The case back may be formed by uniting the heat conducting part with the heat insulating part by screwing threaded grooves, cut in respective joining surfaces thereof, into each other.

The heat insulating part of the case back is preferably made of plastics, and a butting surface part of the heat insulating part, facing the case, is preferably provided with an engagement part made of metal.

Further, the heat insulating part of the case back is preferably provided with a sloped face gently slanting towards the outer periphery thereof. It is more preferable that the heat conducting part of the case back is provided with a collar extended in such a way as to shield the sloped face.

Still further, the invention provides a thermoelectric power generating timepiece comprising a dial, and a movement, installed within a hermetically enclosed space, defined by a case made of metal with a glass fixedly attached thereto, and a case back, further comprising a thermoelectric element for serving as a power supply source of the movement, housed in a gap between the movement and the case back through the intermediary of an upper protection sheet and a lower protection sheet, in contact with the movement, and the case back, respectively, wherein a heat conduction sheet annular in shape, having an opening larger in size than the outside shape of the thermoelectric element, is disposed so as to be in contact with a face of the upper protection sheet, on the side in contact with the thermoelectric element, and so as to be sandwiched between the case and the case back.

In the case of the thermoelectric power generating timepiece described above, the heat conduction sheet is preferably made of a metallic material.

Further, an elastic member is preferably disposed on at least not less than one spot between the lower protection sheet and the case back, between the upper protection sheet and the movement, between the case and the heat conduction sheet, and/or between the upper protection sheet and the heat conduction sheet.

Or a spacer is preferably disposed between the upper protection sheet and the movement.

In such a case, it is more preferable that a first elastic member is disposed between the lower protection sheet and the case back, a second elastic member is disposed between the upper protection sheet and the movement, a third elastic member is disposed between the case and the heat conduction sheet, a fourth elastic member is disposed between the upper protection sheet and the heat conduction sheet, and the spacer is disposed between the upper protection sheet and the movement.

In the abovementioned cases, the elastic member may be a compressible and heat conductive sheet having a high thermal conductivity. Also, the spacer is preferably made of a metallic material.

Further, the invention also provides a case back for a thermoelectric power generating timepiece, defining a hermetically enclosed space together with a case made of metal with a glass fixedly attached thereto, containing a dial, a movement, and a heat conduction sheet therein, further defining an enclosed space together with the heat conduction sheet, for housing a thermoelectric element serving as a power supply source of the movement therein. The case back is made of not less than two kinds of constituent materials each having a different thermal conductivity.

The case back for the thermoelectric power generating timepiece according to the invention preferably comprises a heat conducting part having a high thermal conductivity, formed in a shape larger in outer size than the thermoelectric element, and disposed opposite to the thermoelectric element, and a heat insulating part having a low thermal conductivity, formed so as to be disposed on the outside of the heat conducting part.

Further, the heat insulating part of the case back is preferably provided with a sloped face gently slanting towards the outer periphery thereof.

BEST MODE FOR CARRYING OUT THE INVENTION

Figure 20:
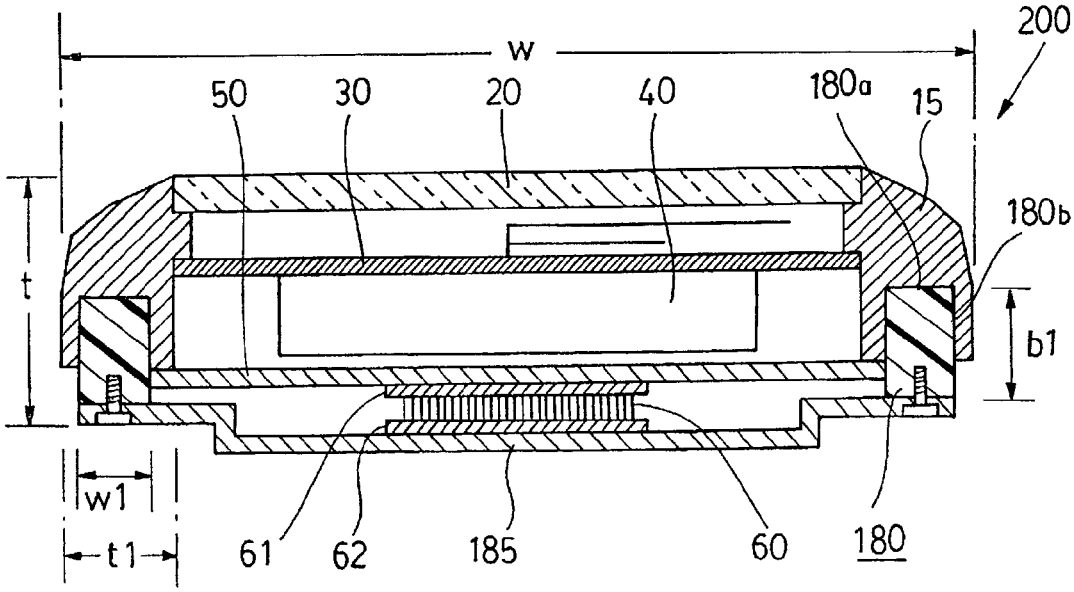
FIG. 20 PRIOR ART
FIG. 20 is a sectional view showing the construction of a conventional thermoelectric power generating timepiece.

Preferred embodiments of a thermoelectric power generating timepiece, and a case back therefor according to the invention will be described in detail hereinafter with reference to the accompanying drawings. In these figures, parts corresponding to those of the conventional thermoelectric power generating timepiece 200 shown in FIG. 20 are denoted by like reference numerals.

First Embodiment: FIGS. 1 to 5, FIGS. 10 to 12

Figure 1:
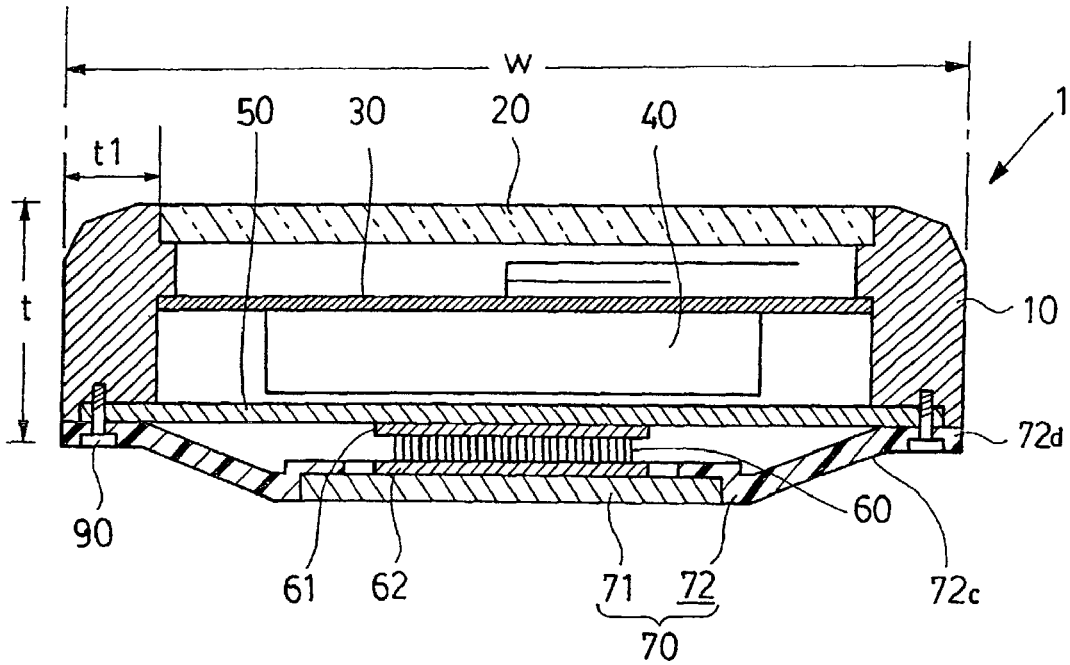
FIG. 1 is a sectional view showing the construction of a first embodiment of a thermoelectric power generating timepiece according to the invention.

FIG. 1 is a sectional view showing the construction of a first embodiment of a thermoelectric power generating timepiece, using a case back for the thermoelectric power generating timepiece (referred to hereinafter merely as a case back), according to the invention. The thermoelectric power generating timepiece 1 comprises a dial 30, a movement 40, and a heat conduction sheet 50, installed within an airtight main body of the timepiece, made up of a case 10 made of metal, with a glass 20 fixedly attached thereto, and a case back 70, further comprising a thermoelectric element 60 for serving as a power supply source of the movement 40, housed in a gap between the heat conduction sheet 50 and the case back 70.

Figure 11:
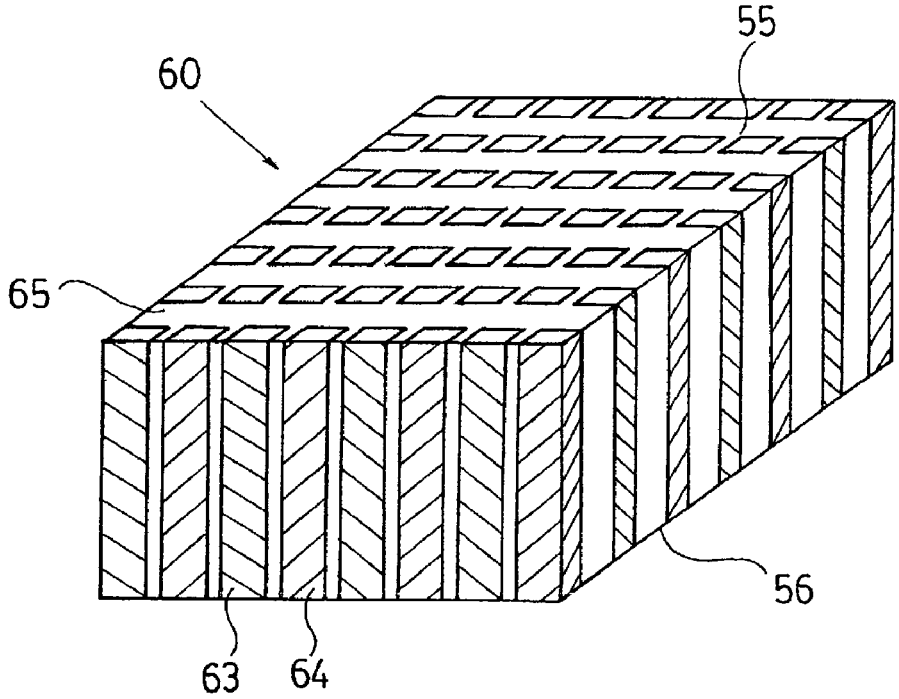
FIG. 11 is an enlarged perspective view schematically showing a thermoelectric element used in the thermoelectric power generating timepiece according to the invention.
Figure 12:
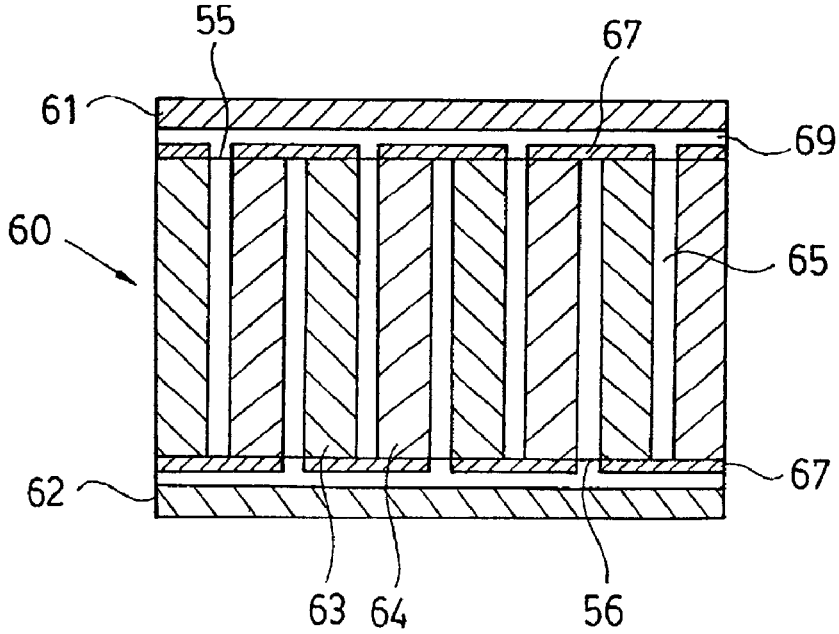
FIG. 12 is an expanded sectional view schematically showing the thermoelectric element with an upper protection sheet and a lower protection sheet, fixedly attached thereto.

As shown in FIG. 11, the thermoelectric element 60 comprises a multitude of n-type rod-like elements 63 each obtained by working a n-type semiconductor into a rod-like shape, and a multitude of p-type rod-like elements 64 each obtained by working a p-type semiconductor into a rod-like shape, wherein the respective n-type rod-like elements 63 as well as p-type rod-like elements 64 are bonded integrally with each other with an insulating resin layer 65 composed of an epoxy resin, interposed therebetween. The respective n-type rod-like elements 63 as well as p-type rod-like elements 64 are composed of a Bi—Te based alloy, and, as shown in FIG. 12, make up thermocouples with a conductive body 67 formed at respective opposite end faces thereof.

The respective thermocouples are connected in series via the respective conductive body 67. The respective electroconductors 67 are formed of nickel or gold, deposited by the vapor deposition method. The respective n-type rod-like elements 63 and p-type rod-like elements 64 are in the shape of a slender column with respective end faces, about 90×110 μm in size, and 1500 μm in length. The thermoelectric element 60 has a volume about 7 mm×7.5 mm×1.5 mm, and contains 1240 thermocouples.

With the thermoelectric element 60, an end face 55 on one side thereof serves as a cold junction, and an end face 56 on the opposite side thereof serves as a hot junction. An upper protection sheet 61 and a lower protection sheet 62 are bonded to the end face 55 and the end face 56, respectively, with an adhesive layer 69 composed of a silicone adhesive, interposed therebetween, and the upper protection sheet 61 and the lower protection sheet 62 are disposed so as to cross the respective n-type rod-like elements 63 and p-type rod-like elements 64 at right angles. Both the upper protection sheet 61 and the lower protection sheet 62 are made up of an aluminum sheet having excellent thermal conductivity, with outer surfaces thereof, coated with Almite (trade name), so as to insulate the respective n-type rod-like elements 63 and p-type rod-like elements 64 therefrom.

For convenience in explanation given hereinafter, a side of the movement 40 of the thermoelectric power generating timepiece 1, closer to the glass 20, is designated as "an upper side", and a side thereof, closer to the case back 70, as "a lower side".

As shown in FIG. 1, the thermoelectric element 60 is housed inside the thermoelectric power generating timepiece 1 such that the upper protection sheet 61 is kept in contact with the underside surface of the heat conduction sheet 50, and the lower protection sheet 62 is kept in contact with the upper surface of the case back 70.

The heat conduction sheet 50 is disposed underneath the movement 40 such that the peripheral part thereof is sandwiched between the case 10 and the case back 70, and is in contact with the case 10 directly or via a sheet member so as to enable heat conduction therebetween. The heat conduction sheet 50 is also in contact with the upper protection sheet 61 so as to enable heat conduction therewith, however, a heat conductive grease or a sheet member is preferably interposed therebetween to improve heat conduction. For the heat conduction sheet 50, material having excellent thermal conductivity is preferably used as with the case of the conventional thermoelectric power generating timepiece, and an aluminum sheet or a copper sheet is suitable for the purpose.

The case back 70 is made of two kinds of materials each having a thermal conductivity differing from that of the other. The case back 70 is made up of a heat conducting part 71 and a heat insulating part 72, and the heat conducting part 71 and the heat insulating part 72 are joined integrally with each other by the insert molding method.

The heat conducting part 71 is made of material having an excellent thermal conductivity, such as metal, and the like, and is formed in the shape of a thin disk larger in outer size than the thermoelectric element 60, and slightly larger than the lower protection sheet 62, so as to be disposed opposite to the thermoelectric element 60.

Figure 2:
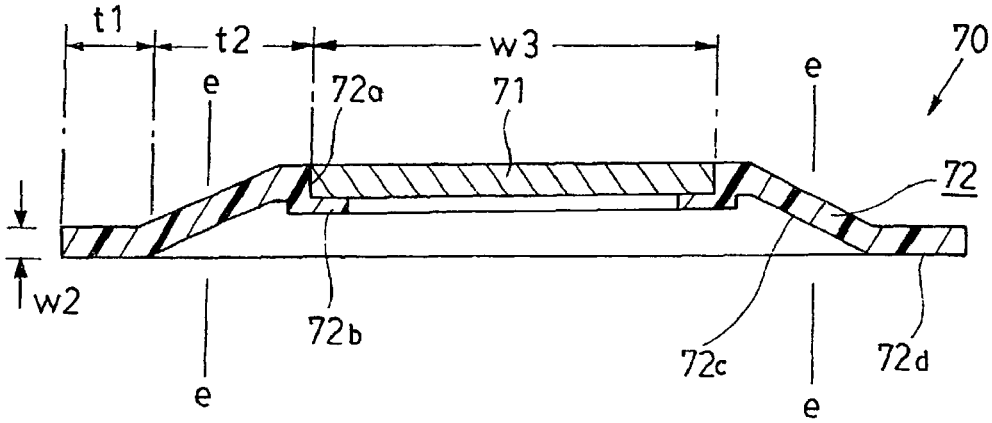
FIG. 2 is a sectional view showing the construction of a case back for a thermoelectric power generating timepiece, in a position inverted from that of the same in FIG. 1.

The heat insulating part 72 is made of material having a low thermal conductivity such as plastics, and the like, and is formed so as to be disposed on the outside of the heat conducting part 71. As shown in FIG. 2, the heat insulating part 72 comprises an opening 72*a* defined in a shape corresponding to the heat conducting part 71, in a central region thereof, and a holder part 72*b* for fixedly attaching the heat conducting part 71 thereto. The heat insulating part 72 further comprises a sloped conical surface part 72*c* gently slanting towards the outer periphery of the heat insulating part 72, formed around the opening 72*a*, and a butting surface part 72*d* facing the case 10, formed in the peripheral region of the sloped conical surface part 72*c*.

The case back 70 is fixedly attached to the case 10 by securing the butting surface part 72*d* to the case 10 with screws 90 with the heat conducting part 71 kept in such a posture as it is protruded from the heat conduction sheet 50.

The thermoelectric element 60 is disposed in an enclosed space formed between the case back 70 and the heat conduction sheet 50 so as to come into contact with the heat conducting part 71 and the heat conduction sheet 50 through the intermediary of the lower protection sheet 62 and the upper protection sheet 61, respectively.

With the thermoelectric power generating timepiece 1 constructed as described above, conduction of heat from the heat conduction sheet 50 to the case 10 occurs, and the case 10 is cooled down by the outside air, whereupon heat conducted thereto is radiated. Consequently, the upper protection sheet 61 is cooled down, and the end face of the thermoelectric element 60, coming in contact therewith, acts as the cold junction. Meanwhile, when the thermoelectric power generating timepiece 1 is worn on the arm of a user, there occurs conduction of heat of the arm from the heat conducting part 71 of the case back 70 to the lower protection sheet 62, thereby warming the lower protection sheet 62. Accordingly, the other end face of the thermoelectric element 60, coming in contact with the lower protection sheet 62, acts as the hot junction.

However, since the heat insulating part 72 having the low thermal conductivity is formed around the heat conducting part 71, conduction of heat of the arm from the heat conducting part 71 to the case 10 is blocked by the agency of the heat insulating part 72, and is inhibited, so that there hardly occurs conduction of heat of the arm from the heat conducting part 71 to the case 10 through the heat insulating part 72.

Thus, the thermoelectric element 60 can maintain a satisfactory difference in temperature because conduction of heat from the case back 70 to the case 10 can be sufficiently controlled. With the satisfactory difference in temperature as maintained, a thermal electromotive force sufficient for driving the movement 40, corresponding to the satisfactory difference in temperature, can be obtained from the thermoelectric element 60.

Furthermore, with the case back 70, the heat insulating part 72 is provided with the sloped conical surface part 72*c* while the heat conducting part 71 is held in a fixed position protruding from the heat conduction sheet 50. Accordingly, when the thermoelectric power generating timepiece 1 is worn on the arm, there is formed some spacing between the arm and the sloped conical surface part 72*c* even if the heat conducting part 71 is in contact with the arm. It is therefore possible to prevent the heat insulating part 72 itself from being warmed up by heat of the arm.

Further, the heat conducting part 71 of the case back 70 may be formed of material having a high thermal conductivity such as metal, and the like, and material in common use for timepieces, such as for example, stainless steel, aluminum, titanium, brass, and copper, may be used for the heat conducting part 71. The heat insulating part 72 may be formed of material having a low thermal conductivity, and besides plastics, use may be made of ceramics, glass, and so forth, having a thermal conductivity lower than that of the constituent material of the case back 70, such as metal, and the like.

Now, using models, thermal insulation properties in the case of the first embodiment of the thermoelectric power generating timepiece 1 according to the invention are hereinafter compared with those for the conventional thermoelectric power generating timepiece 200. It is assumed that the outer dimensions of both are the same, and as shown in FIGS. 1 and 20, respectively, a diameter w is about 30 mm, and a thickness t of the main body is about 8 mm. Further, a wall thickness t1 of the case 10 as well as the case 15 is assumed to be about 3.5 mm.

First, with the conventional thermoelectric power generating timepiece 200, assuming that a thickness w1 of the heat insulating cases 180, in the radial direction thereof, is 2 mm, a sectional area s thereof is found by the following formula:

$$s=\pi(15^2-13^2)=\text{about } 176 \text{ mm}^2$$

Further, assuming that a length b1 of the heat insulating cases 180, in the longitudinal axial direction thereof, is 5 mm, a length thereof, contributing in effect to thermal insulation, is shorter than 5 mm, and is presumed to be on the order of 3 mm because not only an end face 180*a* of the heat insulating cases 180 but also a side face 180*b* thereof are in contact with the case 15, thereby causing conduction of heat to the case 15 to occur from the side face 180*b* as well.

Meanwhile, thermal conductivity of plastics being on the order of 0.3 W/mK, with the case of the conventional thermoelectric power generating timepiece 200, thermal conduction per 1° C. at insulated parts thereof is found as follows:

$$0.3\times176\div3\times0.001=\text{about } 0.018 \text{ W}$$

In contrast, with the thermoelectric power generating timepiece 1 according to the invention, it is assumed that a thickness w2 of the case back 70, shown in FIG. 2, is 0.8 mm, and a diameter w3 of the heat conducting part 71 is 16 mm. Since the butting surface part 72*d* is in direct contact with the case 10, consideration of the sloped conical surface part 72*c* contributing in effect to thermal insulation will suffice for determining the thermal insulation properties of the case back 70.

Figure 10:
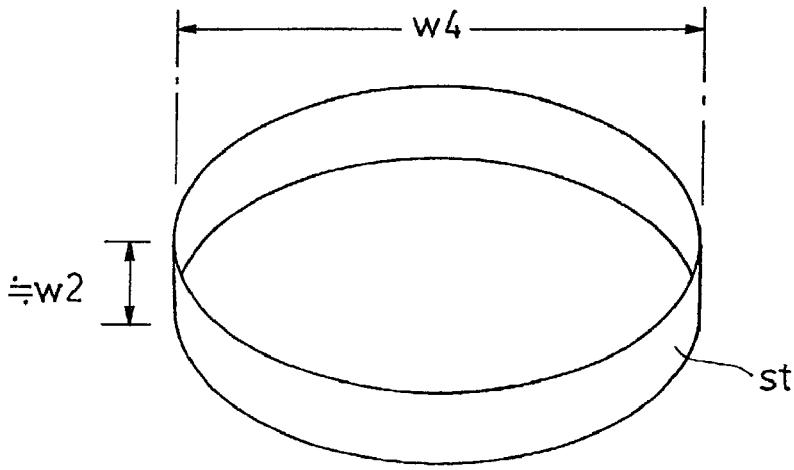
FIG. 10 is a perspective view schematically showing a cut face of the sloped conical surface part of the case back, formed by cutting at midpoint thereof widthwise.

Since the wall thickness t1 of the case 10 is about 3.5 mm as shown in FIGS. 1 and 2, a width t2 of the sloped conical surface part 72*c* is about 3.5 mm. Accordingly, if consideration is given to a cut face of the sloped conical surface part 72*c* as cut along line e-e in FIG. 2, at midpoint thereof widthwise, the cut face st is formed in the shape of an annular ring with a diameter w4 of about 16+3.5=19.5 mm, and a width w2 of about 0.8 mm as shown in FIG. 10, so that an area of the cut face st. is $\pi\times19.5\times0.8=$about 49 mm$^2$. Accordingly, thermal conduction per 1° C. at insulated parts of the thermoelectric power generating timepiece 1 is found as follows:

$$0.3\times49\div3.5\times0.001=\text{about } 0.004 \text{ W}$$

Thus, with the thermoelectric power generating timepiece 1 according to the invention, an amount of heat conducted from the case back 70 to the case 10 can be held down to not more than a half of that for the conventional thermoelectric power generating timepiece 200. Consequently, with the thermoelectric power generating timepiece 1, the difference in temperature, given to the thermoelectric element 60, can be rendered greater than that in the case of the conventional thermoelectric power generating timepiece. Further, a simulation was conducted on the thermoelectric power generating timepiece 1 and the thermoelectric power generating timepiece 200, respectively, to calculate the difference in temperature, given to the thermoelectric element 60, in respective cases, and results of such calculation show that in contrast to the difference in temperature of about 1.3° C. for the conventional thermoelectric power generating timepiece 200, the difference in temperature for the thermoelectric power generating timepiece 1 according to the invention was about 2.0° C., indicating a drastic improvement.

Variations on the Case Back

Figure 3:
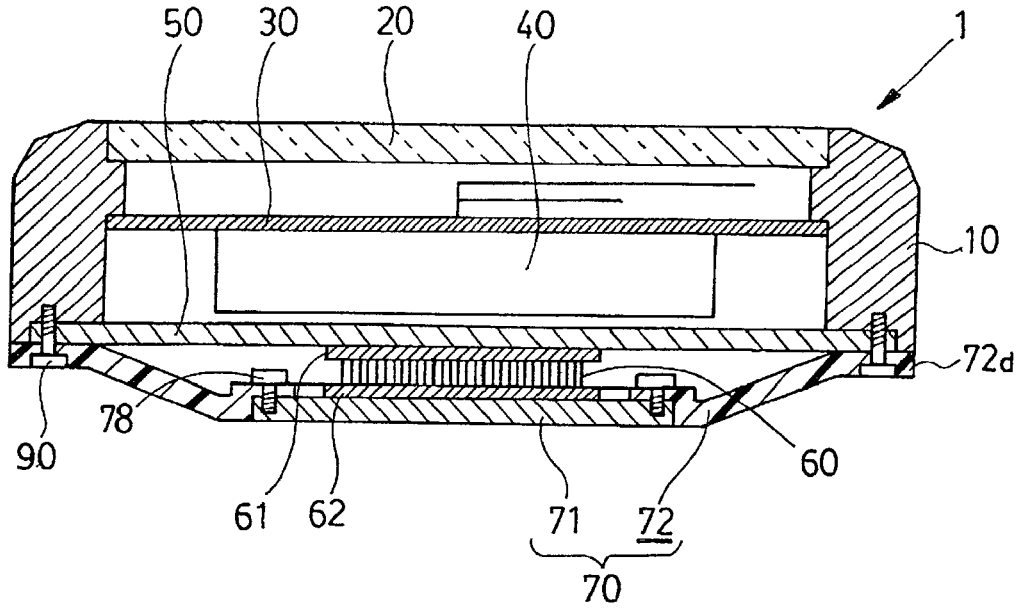
FIG. 3 is a sectional view similar to FIG. 1, showing the construction of the thermoelectric power generating timepiece employing a case back different from that shown in FIG. 2.

Subsequently, variations on the case back 70 for the first embodiment are described hereinafter. With the case back 70 described above, the heat conducting part 71 is formed integrally with the heat insulating part 72 by the insert molding method, however, if it is difficult to perform insert-molding, the heat conducting part 71 may be united with the heat insulating part 72 by securing both parts together with screws 78 as shown in FIG. 3. Even with a case back 70 formed as described above, it is possible to obtain an operational effect equivalent to that for the case where the both parts are joined together by the insert molding method. In the case of joining the heat conducting part 71 and the heat insulating part 72 together with the screws 78 as in the case of this case back 70 described, however, packings are preferably interposed between the heat conducting part 71 and the heat insulating part 72 from the viewpoint of enhancing waterproofness. If waterproofness is not highly required, joining surfaces of the heat conducting part 71 and the heat insulating part 72 may be simply bonded to each other.

Figure 4:
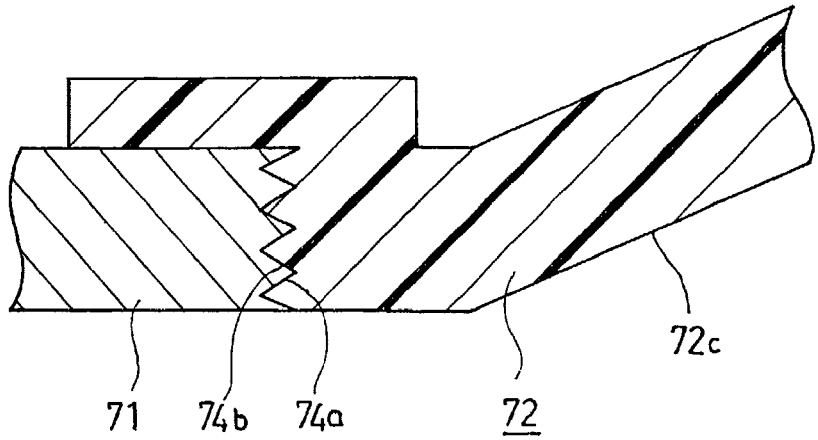
FIG. 4 is a partially expanded sectional view showing a variation of the case back for the thermoelectric power generating timepiece according to the invention.

Also, as shown in FIG. 4, threaded grooves 74*a*, 74*b* may be cut in the respective joining surfaces of the heat conducting part 71 and the heat insulating part 72, and the heat conducting part 71 may be united with the heat insulating part 72 by screwing the threaded grooves 74*a*, 74*b* into each other.

Figure 5:
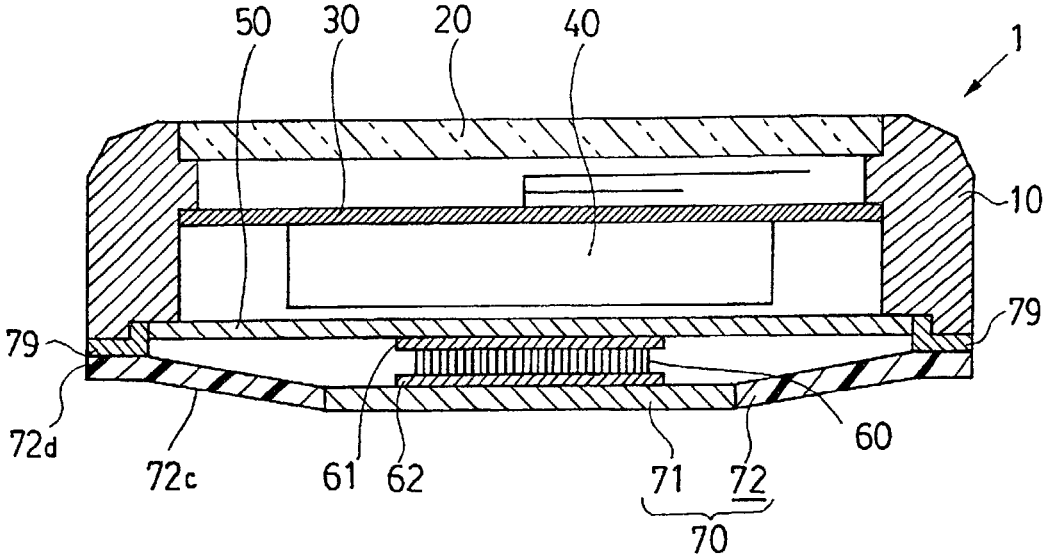
FIG. 5 is a sectional view similar to FIG. 1, showing the construction of the thermoelectric power generating timepiece employing case back different from that shown in FIG. 2.

Further, as shown in FIG. 5, the case back 70 may be fixedly attached to the case 10 with an engagement part 79 made of metal, providing on the butting surface part 72*d* of the heat insulating part 72.

The case back 70 shown in FIG. 1 is fixedly attached to the case 10 by use of the screws 90. The heat insulating part 72 is formed of material having a low thermal conductivity such as plastics, and in contrast, the case 10 is formed of metal. Accordingly, if both parts are provided with an engagement part, respectively, and the respective engagement parts are fitted to each other, this will cause no problem in respect of the performance of the timepiece, but is presumed to pose a difficulty with strength. Nevertheless, taking into consideration easiness with which assembling can be performed, easiness with which maintenance work can be performed, and so forth, it is regarded appropriate means for fixedly attaching the case back 70 to the case 10 to fit the respective engagement parts to each other.

Accordingly, the butting surface part 72*d* of the heat insulating part 72, facing the case 10, is preferably provided with the engagement part 79 made of metal, so that the engagement part 79 is fitted to. an engagement part provided in the case 10, thereby fixedly attaching the case back 70 to the case 10. By so doing, opening/closing with the case back 70 is rendered easier, so that the assembling of the thermoelectric power generating timepiece 1 becomes simple, and easiness with which the maintenance work is performed can be enhanced.

The engagement part 79 may be provided by bonding the same to the butting surface part 72*d* of the heat insulating part 72, but may be formed integrally with the heat insulating part 72 by the insert molding method. Otherwise, the engagement part 79 may be provided by securing the same to the butting surface part 72*d* with screws. The case back 70 provided with the engagement part 79 comprises the heat conducting part 71, the heat insulating part 72, and the engagement part 79, so that the case back 70 is made of not less than two kinds (three kinds) of constituent materials, each having a different thermal conductivity.

Even without providing the engagement part 79, if the heat insulating part 72 is formed of material having a low thermal conductivity such as plastics, blended with glass fiber, it follows that the case back 70 can be made of not less than two kinds (three kinds) of constituent materials, each having a different thermal conductivity, and furthermore, the strength of the case back 70 also can be enhanced.

Figure 6:
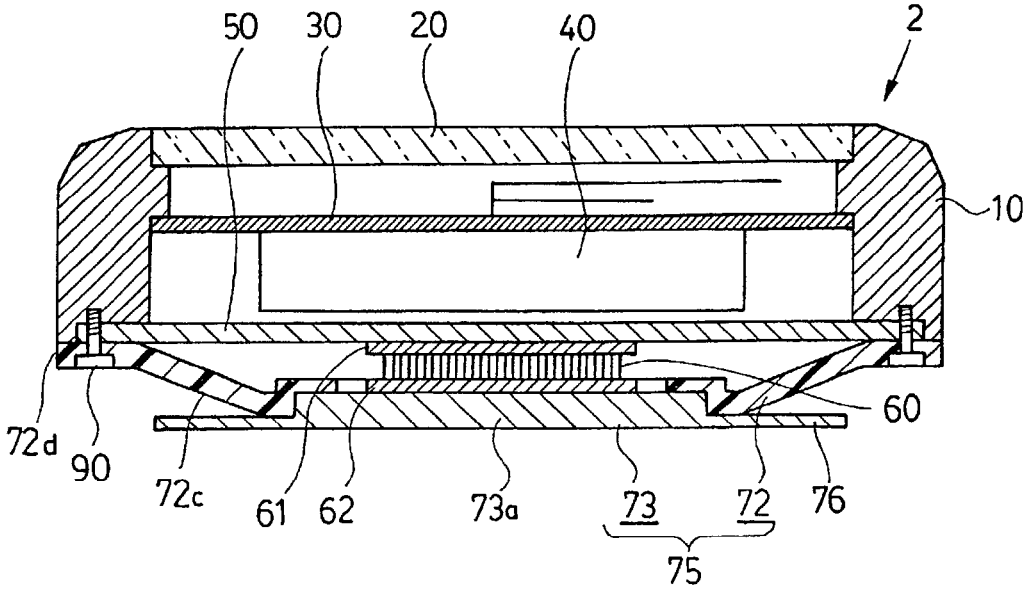
FIG. 6 is a sectional view showing the construction of a second embodiment of a thermoelectric power generating timepiece according to the invention.

Second Embodiment: FIG. 6

Subsequently, a second embodiment of a thermoelectric power generating timepiece, and a case back for the thermoelectric power generating timepiece, according to the invention, are described hereinafter. FIG. 6 is a sectional view showing the construction of the thermoelectric power generating timepiece. The thermoelectric power generating timepiece 2 differs from the thermoelectric power generating timepiece 1 according to the first embodiment of the invention only in respect of a case back 75 for the thermoelectric power generating timepiece (referred to hereinafter merely as a case back), and is the same as the thermoelectric power generating timepiece 1 in other respects. Accordingly, description given hereinafter centers around points of difference, omitting or simplifying description of points in common to both.

The thermoelectric power generating timepiece 2 has a construction enabling a thermoelectric element 60 to be efficiently provided with a difference in temperature even under a variety of timepiece-carrying conditions, taking into consideration a possibility that conditions in which the timepiece is worn on the arm of a user to be carried will vary depending on the user, such as, for example, a case of a user wearing the timepiece with some allowance given for the thickness of the arm of the user, a case of a user wearing the timepiece in such a way as to snugly fit to the thickness of the arm of the user, and so forth.

The case back 75 of the thermoelectric power generating timepiece 2 differs from the case back 70 of the thermoelectric power generating timepiece 1 according to the first embodiment in that a heat conducting part 73 is provided in place of the heat conducting part 71 of the case back 70. The heat conducting part 73 comprises a disk part 73*a* slightly larger in diameter than a lower protection sheet 62, and a collar 76 annular in shape, extending in a planar direction in such a way as to shield a sloped conical surface part 72*c*.

When the thermoelectric power generating timepiece 2 is worn on the arm of a user, there is obtained the following operational effect differing from that for the thermoelectric power generating timepiece 1. In some cases, the thermoelectric power generating timepiece 2 is shifted along the surface of the arm of a user, corresponding to various angles at which the arm wearing the thermoelectric power generating timepiece 2 is, for example, bent. Then, in the case of the thermoelectric power generating timepiece 1 which is not provided with the collar 76, there is a risk of the arm coming in contact with a heat insulating part 72, whereupon temperature on the surface of the arm is transferred to the heat insulating part 72.

However, if the case back 75 is provided with the collar 76 as in the case of the thermoelectric power generating timepiece 2, since the collar 76 is disposed between the heat insulating part 72 and the surface of the arm in such a way as to shield the heat insulating part 72, the risk of the arm coming into contact with the heat insulating part 72 is eliminated even when a posture of the thermoelectric power generating timepiece 2 changes, so that there always exists a clearance between the arm and the heat insulating part 72.

Thus, conduction of heat from the arm to a case 10 is blocked, thereby enhancing thermal insulation efficiency.

The collar 76 shown in FIG. 6 extends in the planar direction from the disk part 73*a*, but may be slightly inclined along the heat insulating part 72. Such configuration is preferable because a clearance between the collar 76 and the heat insulating part 72 is narrowed down, thereby rendering the clearance less susceptible to intrusion of dust, dirt, and so forth.

Figure 7:
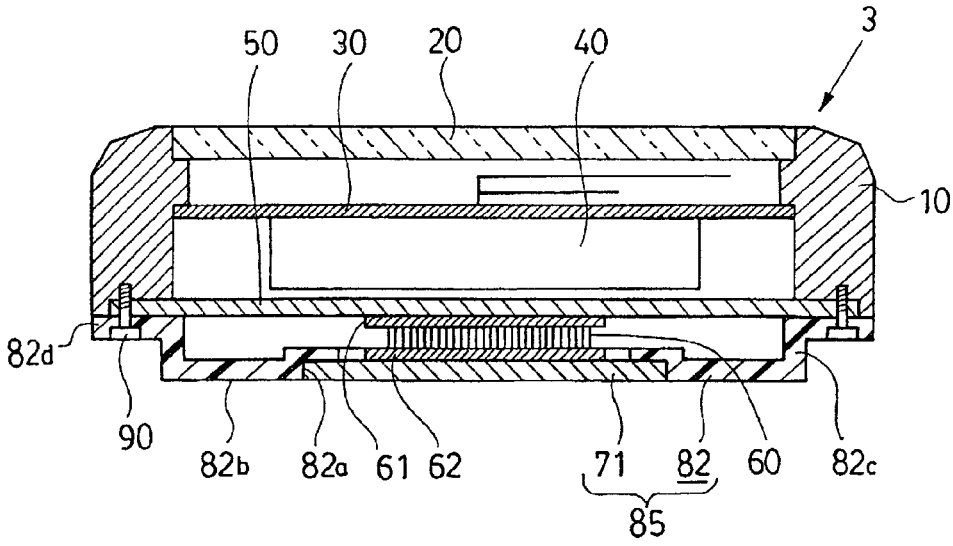
FIG. 7 is a sectional view showing the construction of a third embodiment of a thermoelectric power generating timepiece according to the invention.
Figure 8:
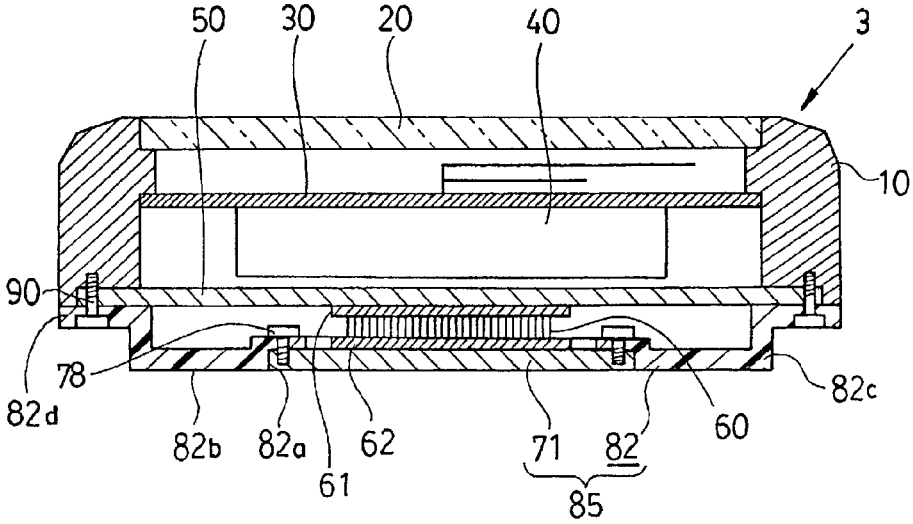
FIG. 8 is a sectional view similar to FIG. 7, showing the construction of the thermoelectric power generating timepiece employing a case back different from that shown in FIG. 7.
Figure 9:
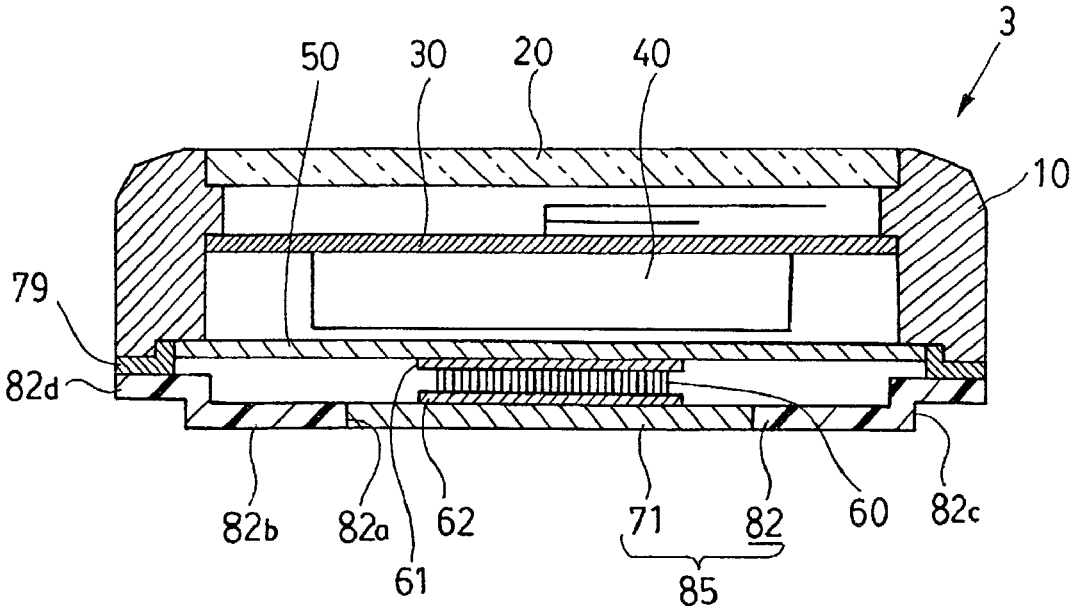
FIG. 9 is a sectional view similar to FIG. 7, showing the construction of the thermoelectric power generating timepiece employing another case back different from that shown in FIG. 7.

Third Embodiment: FIGS. 7 to 9

Subsequently, a third embodiment of a thermoelectric power generating timepiece, and a case back for the thermoelectric power generating timepiece, according to the invention, are described hereinafter. FIG. 7 is a sectional view showing the construction of the thermoelectric power generating timepiece. The thermoelectric power generating timepiece 3 differs from the thermoelectric power generating timepiece 1 according to the first embodiment of the invention only in respect of a case back 85 for the thermoelectric power generating timepiece (referred to hereinafter merely as a case back), and is the same as the thermoelectric power generating timepiece 1 in other respects. Accordingly, description given hereinafter centers around points of difference, omitting or simplifying description of points in common to both.

The case back 70 according to the first embodiment is made up of the heat conducting part 71 and the heat insulating part 72, and the heat insulating part 72 is provided with the sloped conical surface part 72*c*, however, a case back 85 according to the third embodiment is made up of the same heat conducting part 71 as that of the case back 70, and a heat insulating part 82 differing from the heat insulating part 72. The heat conducting part 71 and the heat insulating part 82 are made of respective constituent materials, each having a thermal conductivity differing from that of the other. The heat insulating part 82 is comprised of an opening 82*a* in a shape corresponding to the heat conducting part 71, an annular flat part 82*b* formed around the opening 82*a*, a stepped part 82*c* formed around the annular flat part 82*b*, and a butting surface part 82*d* facing a case 10, formed around the stepped part 82*c*.

The case back 85 is fixedly attached to the case 10 by securing the butting surface part 82*d* to the case 10 with screws 90 while keeping the heat conducting part 71 and the annular flat part 82*b* in a posture protruding from a heat conduction sheet 50.

With the thermoelectric power generating timepiece 3 according to the third embodiment, the heat insulating part 82 having a low thermal conductivity is formed around the heat conducting part 71 as with the case of the thermoelectric power generating timepiece 1 according to the first embodiment, so that conduction of heat of the arm of a user to the case 10 is inhibited. Consequently, there hardly occurs conduction of heat of the arm from the heat conducting part 71 to the case 10 through the heat insulating part 82.

However, since the annular flat part 82*b* of the heat insulating part 82 as well as the heat conducting part 71 is held in a fixed position protruding from the heat conduction sheet 50, there is a possibility of the arm coming into contact with the annular flat part 82*b*. Nevertheless, there hardly occurs conduction of heat of the arm to the case 10 because the annular flat part 82*b* is formed of material having a low thermal conductivity such as plastics, and the like. Accordingly, with the thermoelectric power generating timepiece 3 as well, an operational effect equivalent to that for the thermoelectric power generating timepiece 1 can be obtained, thereby enabling a thermoelectric element 60 to be provided with a sufficient difference in temperature.

Further, with the case back 85 as well, the heat conducting part 71 and the heat insulating part 82 may be formed integrally with each other not only by the insert molding method as with the case of the case back 70, but also be united with each other by securing both parts together with screws 78 as shown in FIG. 8.

Also, as shown in FIG. 9, the case back 85 may be fixedly attached to the case 10 with an engagement part 79 made of metal, provided on the butting surface part 82*d* of the heat insulating part 82. In either case, an operational effect equivalent to that for the thermoelectric power generating timepiece 1 according to the first embodiment can be obtained.

Fourth Embodiment: FIGS. 13 to 19

Figure 13:
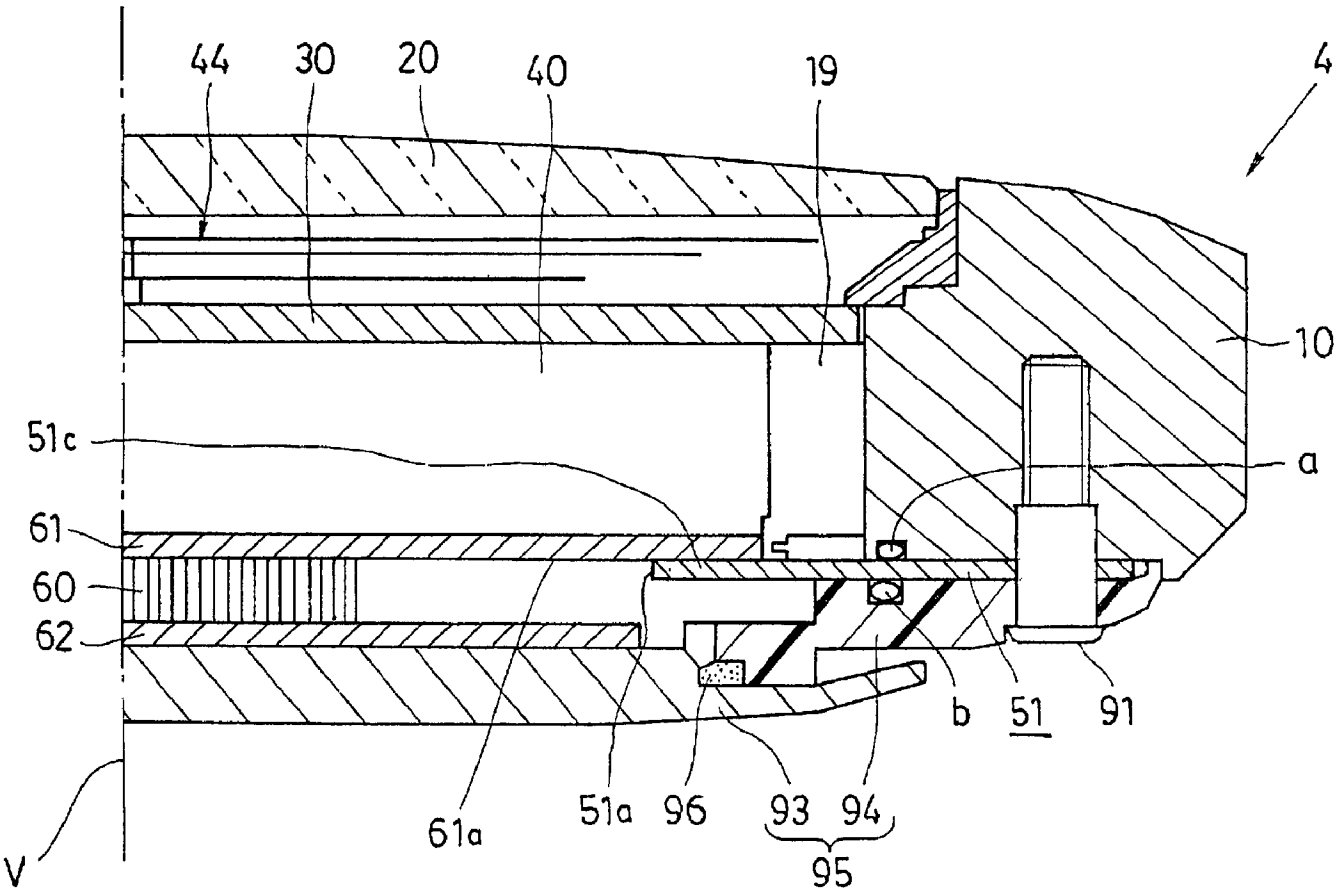
FIG. 13 is a sectional view showing the construction of a fourth embodiment of a thermoelectric power generating timepiece according to the invention, omitting half thereof, on the left-hand side thereof.

Subsequently, a fourth embodiment of a thermoelectric power generating timepiece, and a case back for the thermoelectric power generating timepiece, according to the invention, are described hereinafter. FIG. 13 is a sectional view showing the construction of the thermoelectric power generating timepiece. In the figures, only half of the thermoelectric power generating timepiece 4, on the right-hand side thereof, is shown for convenience in illustration, omitting half thereof, on the left-hand side thereof, however, the thermoelectric power generating timepiece 4 has a construction symmetrical from side to side with respect to an axis v.

The thermoelectric power generating timepiece 4 comprises a dial 30, a movement 40, hands 44 comprised of the second hand, minute hand, and hour hand, a heat conduction sheet 51, and a thermoelectric element 60, which are installed within an air-tight main body of the timepiece, made up of a case 10, with a glass 20 fixedly attached thereto, and a case back 95, rendering the construction thereof more adaptable to enhancement of heat conduction efficiency inside the timepiece than that of the thermoelectric power generating timepiece 1 according to the first embodiment.

As with the thermoelectric element 60 for the thermoelectric power generating timepiece 1 according to the first embodiment, an upper protection sheet 61 and a lower protection sheet 62 are bonded to an end face 55 and an end face 56 of the thermoelectric element 60 according to this embodiment, respectively, with an adhesive layer 69 composed of a silicone adhesive interposed therebetween as shown in FIG. 12, and the thermoelectric element 60 is housed inside the thermoelectric power generating timepiece 4 so as to be in contact with the movement 40 and the case back 95 through the intermediary of the upper protection sheet 61 and the lower protection sheet 62, respectively.

The case back 95 comprises a heat absorbing part 93 for absorbing body heat of a user upon the same coming in contact with the arm of the user when the thermoelectric power generating timepiece 4 is worn by the user, and a heat insulating part 94 for blocking conduction of heat absorbed from the heat absorbing part 93. The heat absorbing part 93 is preferably formed of metal having a high thermal conductivity, and in the case of this embodiment, stainless steel is in use. Further, it is preferable that the heat absorbing part 93 and the lower protection sheet 62 are securely joined together through the intermediary of material having a high thermal conductivity. For the material, use may be made of, for example, heat conductive grease.

On the other hand, for the heat insulating part 94, use is made of material capable of blocking conduction of heat absorbed from the heat absorbing part 93 to the case 10, and use is preferably made of, for example, plastics such as ABS (acrylonitrile-butadiene-styrene copolymer), polycarbonate, and so forth.

Butting surfaces of the heat absorbing part 93 and the heat insulating part 94 are provided with threaded grooves (not shown in the figure) cut therein, respectively, and are joined together by screwing the respective threaded grooves into each other. Further, an adhesive layer 96 made of an epoxy resin based adhesive is provided between the heat absorbing part 93 and the heat insulating part 94 in order to increase strength at a bonded face therebetween.

The heat conduction sheet 51 is formed in an annular shape, having an opening 51 a larger in size than the outside shape of the thermoelectric element 60, and a width thereof wider than a width of the heat insulating part 94, and is made of metal having a high thermal conductivity, for example, stainless steel. The heat conduction sheet 51 is disposed so as to be sandwiched between the case 10 and the heat insulating part 94 with packings a, b, interposed therebetween, respectively, such that the thermoelectric element 60 is positioned inside the opening 51*a*, and an edge portion 51*c* thereof, in a radial direction, on the innermost side thereof, is brought into contact with a face 61*a* of the upper protection sheet 61, on the side in contact with the thermoelectric element 60.

Further, the heat insulating part 94 is provided with screw holes defined therein, and is fixed integrally to the heat conduction sheet 51 and the case 10, both being provided with the same screw holes defined therein, respectively, with screws 91, thereby completing assembling. At this point in time, waterproof effects can be obtained as a result of compression to which the packings a, b are compressed.

Figure 19:
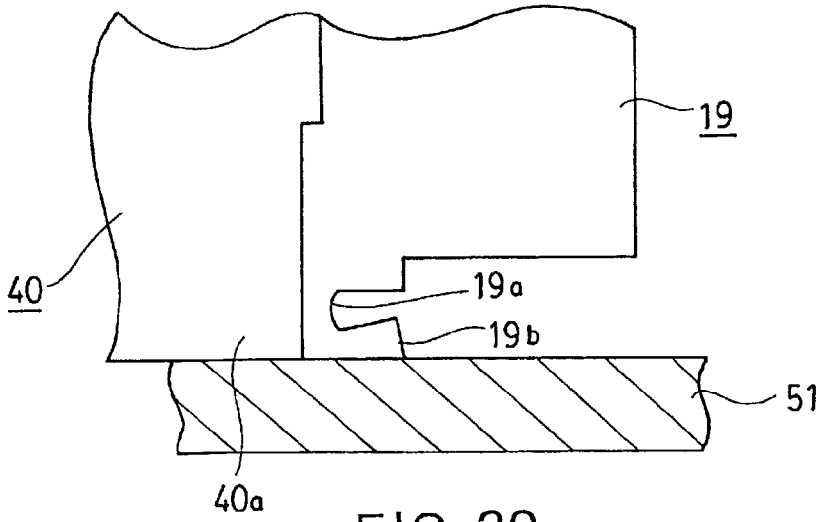
FIG. 19 is an expanded sectional view schematically showing a fixture frame in FIG. 13.

As shown in FIG. 19, the movement 40 is securely attached to a fixture frame 19 made of plastics by securing an edge part 40*a* thereof to the fixture frame 19. In the fixture frame 19, a slit 19*a* and a protrusion 19*b* are formed. The fixture frame 19 has a function of causing the case 10 and the upper protection sheet 61 to come into contact with the heat conduction sheet 51 with reliability due to suitable deformation which the slit 19*a* and the protrusion 19*b* undergo when the fixture frame 19 is pushed by the heat conduction sheet 51 upon attaching the heat insulating part 94 to the case 10. Further, the movement 40 has protruded parts such as a spring, coil, and so forth, on the side thereof, facing a cold junction of the thermoelectric element 60, however, holes corresponding thereto are defined in the upper protection sheet 61, thereby preventing the protruded parts from impinging upon the upper protection sheet 61.

With the thermoelectric power generating timepiece 4 constructed as above, the end face 55 shown in FIG. 12, in contact with the upper protection sheet 61, acts as the cold junction, and the end face 56, in contact with the lower protection sheet 62, acts as a hot junction, thereby providing the thermoelectric element 60 with a difference in temperature.

Now, if the heat conduction sheet 50 is disposed such that the heat conduction sheet 50 is overlaid on the upper protection sheet 61 so as to come into contact with the upper protection sheet 61 from the upper side thereof, and heat is caused to be conducted from the heat conduction sheet 50 to the case 10 as in the case of the thermoelectric power generating timepiece 1, it is difficult to reduce the size of the thermoelectric power generating timepiece 1 because the thickness of the thermoelectric power generating timepiece 1 in whole comes to include the thickness of the upper protection sheet 61, the heat conduction sheet 50, and the case 10, respectively.

In contrast, with the thermoelectric power generating timepiece 4, since the heat conduction sheet 51 is disposed such that the thermoelectric element 60 is positioned inside the opening 51*a* thereof, and the edge portion 51*c* thereof comes into contact with the upper protection sheet 61 from the underside thereof, this is not a case where the upper protection sheet 61 is overlaid on top of the heat conduction sheet 51, resulting in an increase in thickness, and affecting the thickness of the timepiece in whole. In addition, this construction ensures conduction of heat from the upper protection sheet 61 to the case 10 via the heat conduction sheet 51, and consequently, heat radiation through the case 10 can be executed efficiently.

With such a construction comprised of a plurality of components in contact with each other as that for the thermoelectric power generating timepiece 4, however, it is important to adjust variations in dimensions, occurring to the respective components. This is because, in order to enhance heat conduction efficiency inside the timepiece, it is necessary for the respective components from the case back 95 absorbing body heat up to the case 10 dissipating the body heat to come in contact with each other with reliability, thereby effectively executing exchange of heat between the respective components. Further, since use is often made of metallic materials having high thermal conductivity for components in a sheet-like shape, there is a possibility of occurrence of problems such as warpage, and so forth. Accordingly, with the thermoelectric power generating timepiece 4, an elastic member is preferably disposed where necessary as follows, so that contact between the respective components is ensured by absorbing the variations in the dimensions.

Figure 14:
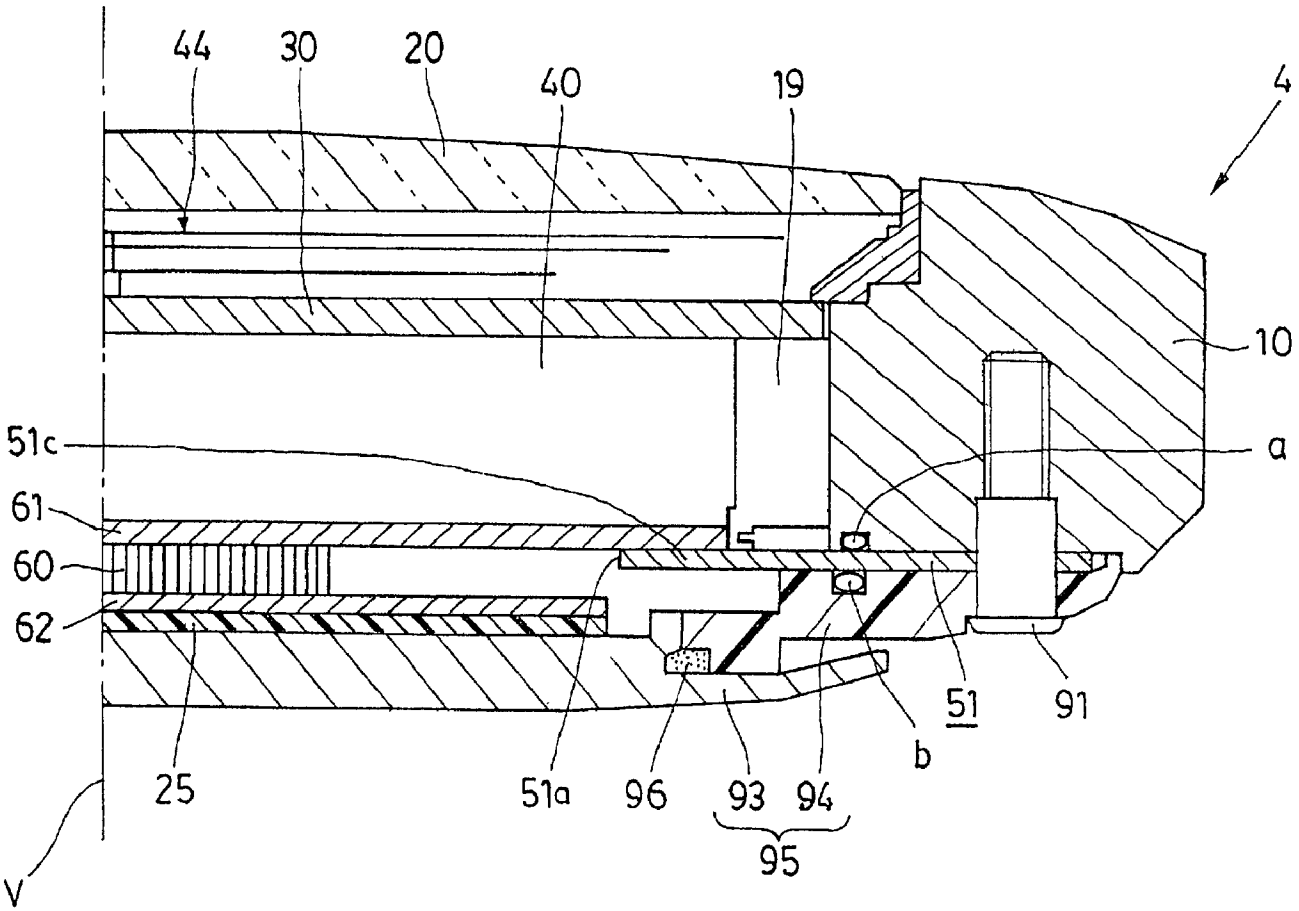
FIG. 14 is a sectional view similar to FIG. 13, showing a variation of the thermoelectric power generating timepiece employing an elastic member.

That is, as in the case of a thermoelectric power generating timepiece 4 shown in FIG. 14, an elastic member 25 which is a first elastic member is preferably disposed between a heat absorbing part 93 of a case back 95 and a lower protection sheet 62.

The elastic member 25 is a sheet-like member formed in a shape corresponding to the lower protection sheet 62, having a high thermal conductivity with excellent conduction of heat, and is made up of a compressible and heat conductive sheet. As a constituent material thereof, use is preferably made of silicone resin. For example, a silicone resin sheet manufactured by Shin-Etsu Chemical Co., Ltd. can be used.

Since the elastic member 25 is formed in a compressible sheet-like shape, the same disposed between the heat absorbing part 93 and the lower protection sheet 62 is compressed by the lower protection sheet 62 and the case back 95 when fixedly attaching the case back 95 to a case 10, thereby undergoing deformation. As a result, even if there exist variations in the dimensions of a thermoelectric element 60 and other components, such variations are absorbed, and even if warpage occurs to sheet-like members, such warpage is absorbed, so that contact between an upper protection sheet 61 and a heat conduction sheet 51 as well as contact between the heat conduction sheet 51 and the case 10 is ensured.

Consequently, excellent conduction of heat from the upper protection sheet 61 to the case 10 via the heat conduction sheet 51 occurs, and radiation of heat through the case 10 can be efficiently executed. Further, since the elastic member 25 has a high thermal conductivity causing excellent conduction of heat, body heat of a user, absorbed from the heat absorbing part 93, is effectively transferred to the lower protection sheet 62 by disposing the elastic member 25 between the heat absorbing part 93 and the lower protection sheet 62. Thus, a difference in temperature, given to the thermoelectric element 60, can be enhanced.

Figure 15:
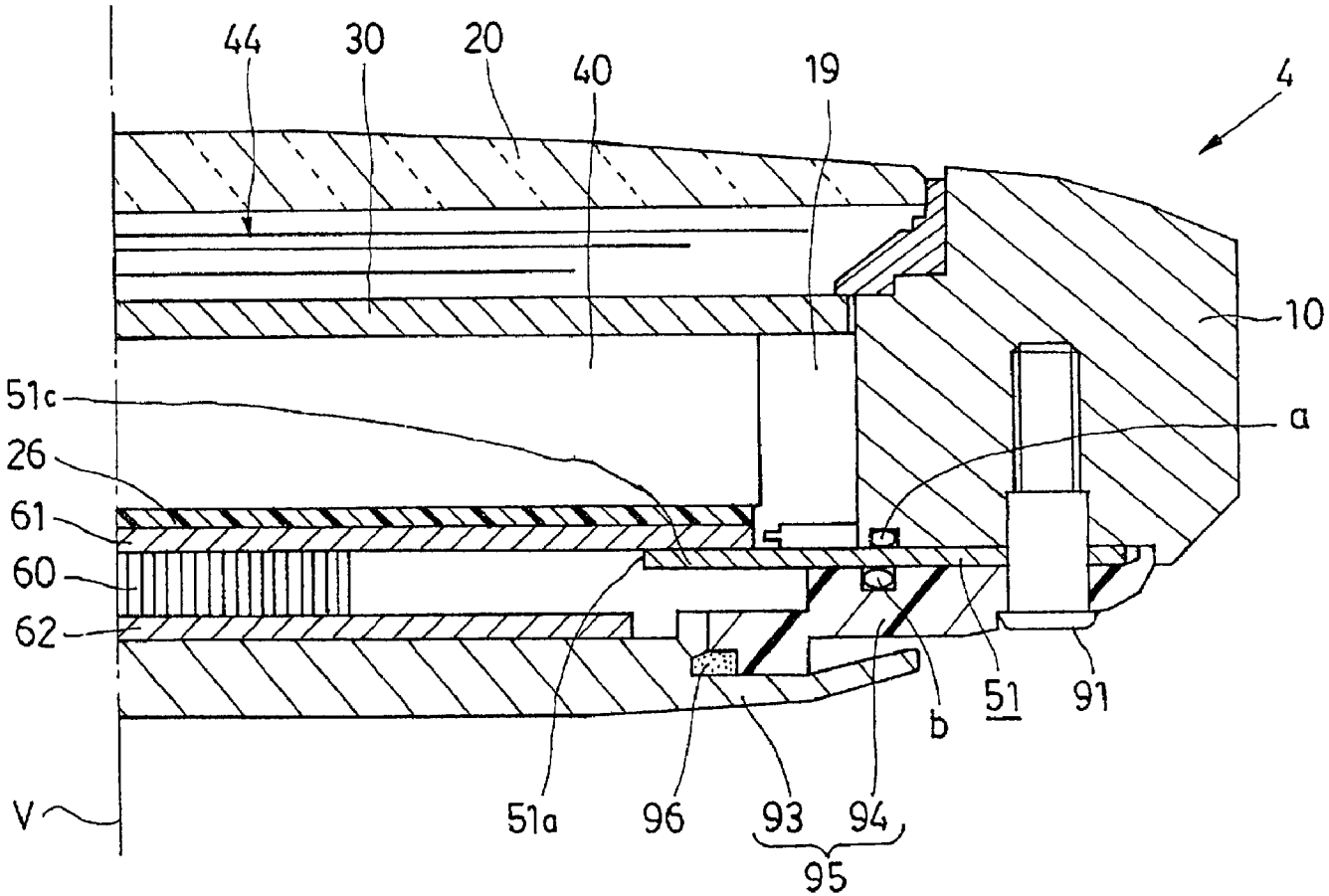
FIG. 15 is a sectional view similar to FIG. 13, showing a variation of the thermoelectric power generating timepiece employing another elastic member.

Further, as in the case of a thermoelectric power generating timepiece 4 shown in FIG. 15, an elastic member 26 which is a second elastic member is preferably disposed between a movement 40 and an upper protection sheet 61.

The elastic member 26 is formed of the same constituent material as that for the elastic member 25, but differs from the latter in that the elastic member 26 is formed in a shape corresponding to the upper protection sheet 61. The elastic member 26 disposed between the movement 40 and the upper protection sheet 61 is compressed by the movement 40 and the upper protection sheet 61 when fixedly attaching a case back 95 to a case 10. As a result, even if there exist variations in the dimensions of a thermoelectric element 60 and other components, such variations are absorbed, thereby ensuring the contact between the upper protection sheet 61 and a heat conduction sheet 51 as well as the contact between the heat conduction sheet 51 and the case 10. Consequently, excellent conduction of heat from the upper protection sheet 61 to the case 10 via the heat conduction sheet 51 occurs, and radiation of heat through the case 10 can be efficiently executed. With the elastic member 26 disposed as above, the variation in the dimensions, in the direction of thickness, can be adjusted, and respective contacts among the movement 40, the elastic member 26, and the upper protection sheet 61 are improved, so that excellent conduction of heat is effected, and radiation of heat from the movement 40 can be efficiently executed without loss.

Further, although the elastic member 26 is in contact with the underside face of the movement 40, protruded parts (not shown) of the movement 40, such as a spring and a coil, are prevented from impinging upon the elastic member 26 and the upper protection sheet 61 because holes are defined in parts of the elastic member 26 and the upper protection sheet 61.

Figure 16:
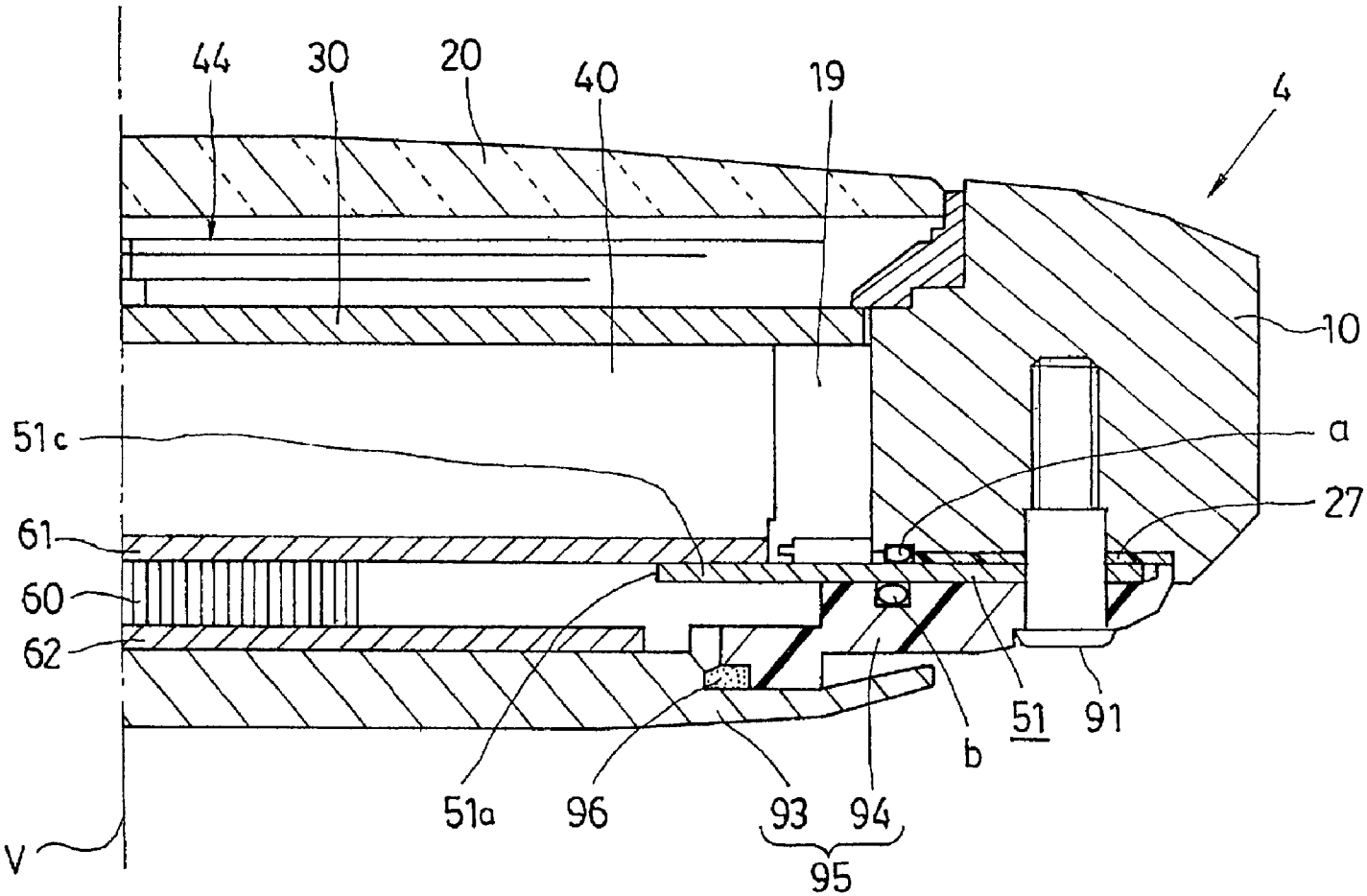
FIG. 16 is a sectional view similar to FIG. 13, showing a variation of the thermoelectric power generating timepiece employing still another elastic member.

Still further, as in the case of a thermoelectric power generating timepiece 4 shown in FIG. 16, an elastic member 27 which is a third elastic member may be disposed between a case 10 and a heat conduction sheet 51.

The elastic member 27 is formed of the same constituent material as that for the elastic member 25, but differs from the latter in that the elastic member 27 is formed in an annular shape having an opening larger than an opening 51*a* of the heat conduction sheet 51. The elastic member 27 disposed between the case 10 and the heat conduction sheet 51 as described above is compressed by the case 10 and the heat conduction sheet 51 when fixedly attaching a case back 95 to the case 10. As a result, even if there exist variations in the dimensions of a thermoelectric element 60 and other components, such variations are absorbed, thereby ensuring the contact between an upper protection sheet 61 and the heat conduction sheet 51 as well as the contact between the heat conduction sheet 51 and the case 10. Consequently, excellent conduction of heat from the upper protection sheet 61 to the case 10 via the heat conduction sheet 51 occurs, and radiation of heat through the case 10 can be efficiently executed.

Figure 17:
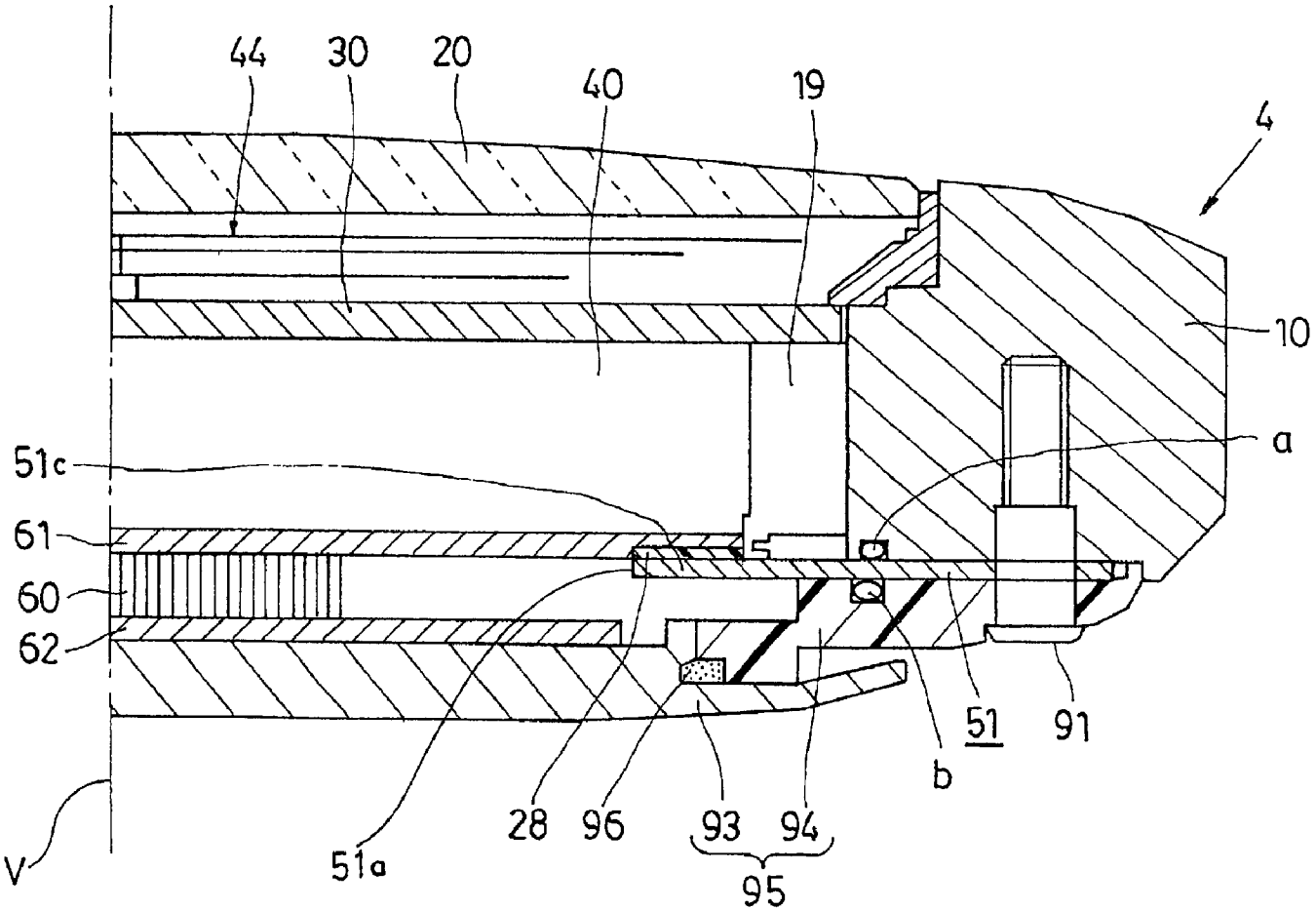
FIG. 17 is a sectional view similar to FIG. 13, showing a variation of the thermoelectric power generating timepiece employing yet another elastic member.

Yet further, as in the case of a thermoelectric power generating timepiece 4 shown in FIG. 17, an elastic member 28 which is a fourth elastic member may be disposed between an upper protection sheet 61 and a heat conduction sheet 51.

The elastic member 28 is formed of the same constituent material as that for the elastic member 25, but differs from the latter in that the elastic member 28 is formed in an annular shape corresponding to the shape of an edge portion 51*c* of the heat conduction sheet 51, having an opening in size corresponding to an opening 51*a* of the heat conduction sheet 51.

The elastic member 28 disposed between the upper protection sheet 61 and the heat conduction sheet 51 as described above is compressed by the upper protection sheet 61 and the heat conduction sheet 51 when fixedly attaching a case back 95 to a case 10. As a result, even if there exist variations in the dimensions of a thermoelectric element 60 and other components, such variations are absorbed, thereby ensuring contact between the upper protection sheet 61 and the heat conduction sheet 51 as well as contact between the heat conduction sheet 51 and the case 10. Consequently, excellent conduction of heat from the upper protection sheet 61 to the case 10 via the heat conduction sheet 51 occurs, and radiation of heat through the case 10 can be efficiently executed.

Figure 18:
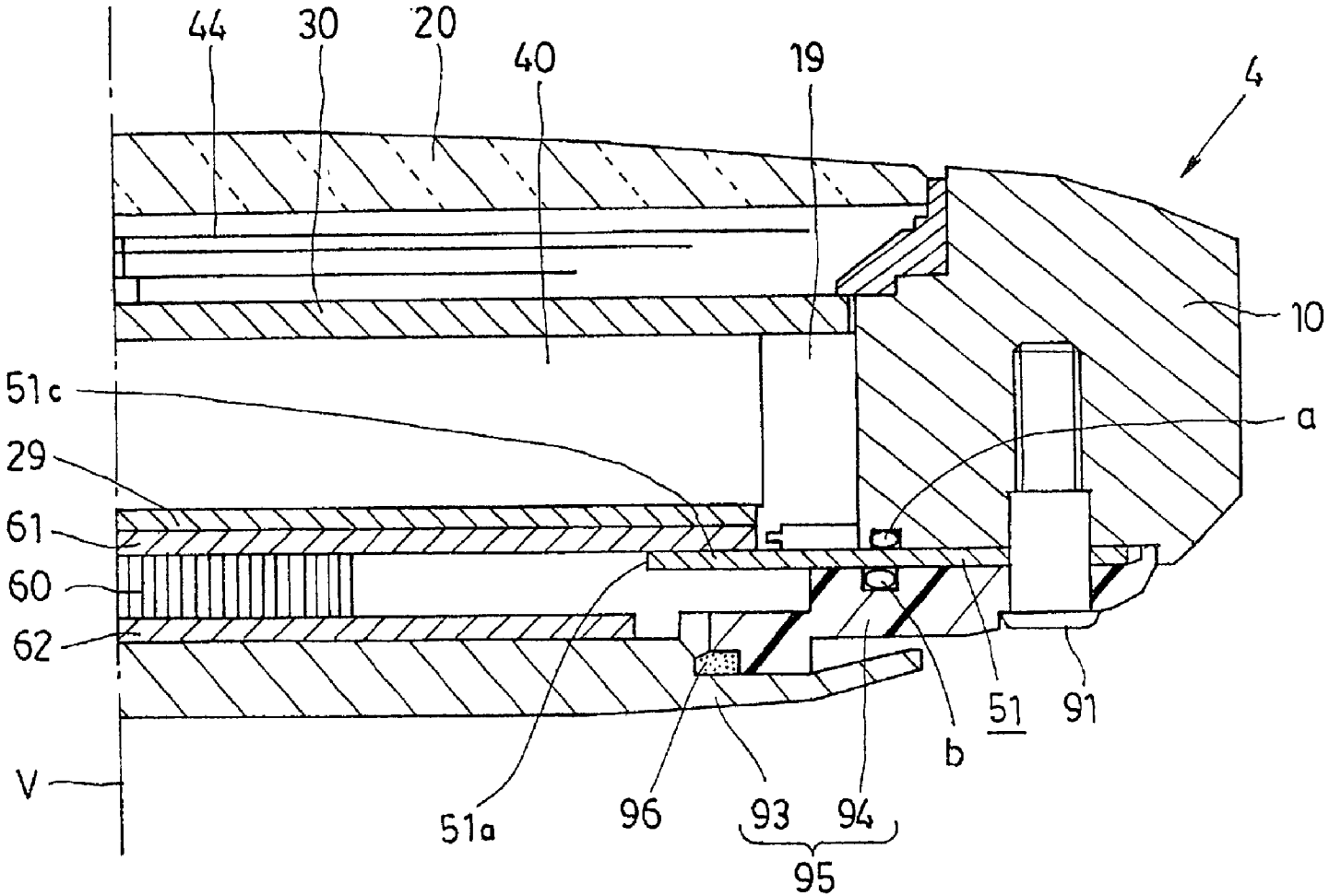
FIG. 18 is a sectional view similar to FIG. 13, showing a variation of the fourth embodiment of the thermoelectric power generating timepiece according to the invention, employing a spacer.

Furthermore, as in the case of a thermoelectric power generating timepiece 4 shown in FIG. 18, a spacer 29 may be disposed between an upper protection sheet 61 and a movement 40.

The spacer 29 is formed in a thin disk-like shape in size corresponding to the upper protection sheet 61, and is made of a metallic material having a high thermal conductivity. As a constituent material of the spacer 29, use is preferably made of, for example, stainless steel from the viewpoint of excellent formability. The spacer 29 disposed between the movement 40 and the upper protection sheet 61 as described above improves contact between the movement 40 and the upper protection sheet 61, and heat conduction efficiency is enhanced, thereby effecting efficient radiation of heat from the movement 40.

Further, the spacer 29 is provided with holes defined in shape corresponding to protruded parts of the movement 40, such as a pin, a spring, a coil, and so forth, thus preventing the protruded parts from impinging thereupon.

As shown in FIGS. 14 to 18, the respective thermoelectric power generating timepieces 4 described hereinbefore are provided with any one selected from the group consisting of the first to fourth elastic members 25 to 28, and the spacer 29. Instead, at least not less than two members among the group of the elastic members 25 to 28 and the spacer 29 may be disposed in combination with each other. In such a case, respective operational effects of the elastic members 25 to 28 and the spacer 29 are synergistically exhibited, thereby enabling conduction of heat absorbed from the heat absorbing part 93 to the thermoelectric element 60, and radiation of heat from the thermoelectric element 60 to the case 10 to be more efficiently executed. Accordingly, the thermoelectric element 60 will be provided with a greater difference in temperature.

INDUSTRIAL APPLICABILITY

The thermoelectric power generating timepiece and the case back for the thermoelectric power generating timepiece, according to the invention, has an advantageous effect of dramatically increasing a difference in temperature, given to the thermoelectric element, because of improvement in thermal insulation properties of the case back over that for the conventional thermoelectric power generating timepiece. Since an output of the thermoelectric element increases in proportion to the square of the difference in temperature between the opposite ends thereof, the thermoelectric power generating timepiece according to the invention comes to have a very high energy efficiency. Accordingly, not only normal driving of the timepiece can be executed with ease but also excess energy, not used in driving, can be increased, enabling such increased energy to be stored in a secondary cell, and so forth. As a result, it becomes possible to drive the timepiece for longer time in case of no carrying even for the same length of carrying time as that for the conventional thermoelectric power generating timepiece.

Further, since an increase in the difference in temperature results in an increase in an amount of electric power generated per unit of a surface area of the thermoelectric element, a thermal electromotive force as required can be secured even if the surface area of the thermoelectric element is reduced, so that the timepiece in whole can be reduced in size, enabling the cost of the thermoelectric element to be cut down.

Still further, by disposing the heat conduction sheet so as to be sandwiched between the case and the case back, internal heat conduction efficiency can be enhanced without affecting the external appearance of the timepiece in whole, thereby enabling the difference in temperature between the opposite ends of the thermoelectric element to be further increased. In addition, by disposing the elastic members or the spacer at various spots inside the timepiece, contact between the respective components can be ensured, and heat conduction therebetween can be effected without loss, thereby further increasing the difference in temperature, given to the thermoelectric element.

What is claimed is:

1. A thermoelectric power generating timepiece comprising a dial, a movement, and a heat conduction sheet, installed within a hermetically enclosed space, defined by a case made of metal with a glass fixedly attached thereto, and a case back, further comprising a thermoelectric element for serving as a power supply source of said movement, housed in a gap between the heat conduction sheet and said case back wherein said case back comprises a heat conducting part having a high thermal conductivity, formed in a shape larger in outer size than the thermoelectric element, and disposed opposite to the thermoelectric element, and a heat insulating part having a low thermal conductivity, formed so as to be disposed on the outside of the heat conducting part; and the heat insulating part of said case back is provided with a sloped conical surface part gently slanting towards the outer periphery thereof.

2. A thermoelectric power generating timepiece according to claim 1, wherein the heat conducting part of said case back is provided with a collar extended in such a way as to shield the sloped face.

3. A thermoelectric power generating timepiece according to claim 1, wherein said heat conducting part of said case back is made of a metallic material, the heat insulating part thereof is made of plastics, and said case back is formed of the metallic material forming the heat conducting part and the plastics forming the heat insulating part by the insert molding method.

4. A thermoelectric power generating timepiece according to claim 1, wherein said case back is formed by uniting said heat conducting part with said heat insulating part by securing both parts together with screws.

5. A thermoelectric power generating timepiece according to claim 1, wherein said case back is formed by uniting said heat conducting part with the heat insulating part by screwing threaded grooves, cut in respective joining surfaces thereof, into each other.

6. A thermoelectric power generating timepiece according to claim 1, wherein said heat insulating part of the case back is made of plastics, and a butting surface part of the heat insulating part, facing said case, is provided with an engagement part made of metal.

7. A thermoelectric power generating timepiece comprising a dial, and a movement, installed within a hermetically enclosed space, defined by a case made of metal with a glass fixedly attached thereto, and a case back, further comprising a thermoelectric element for serving as a power supply source of the movement, housed in a gap between the movement and said case back through the intermediary of an upper protection sheet and a lower protection sheet, in contact with the movement, and the case back, respectively, wherein a heat conduction sheet annular in shape, having an opening larger in size than the outside shape of said thermoelectric element, is disposed so as to be in contact with a face of the upper protection sheet, on the side in contact with the thermoelectric element, and so as to be sandwiched between the case and said case back.

8. A thermoelectric power generating timepiece according to claim 7, wherein said heat conduction sheet is made of a metallic material.

9. A thermoelectric power generating timepiece according to claim 7, wherein an elastic member is disposed between said lower protection sheet and said case back.

10. A thermoelectric power generating timepiece according to claims 9, wherein the elastic member is a compressible and heat conductive sheet having a high thermal conductivity.

11. A thermoelectric power generating timepiece according to claim 7, wherein an elastic member is disposed between said upper protection sheet and said movement.

12. A thermoelectric power generating timepiece according to claim 7, wherein an elastic member is disposed between said case and said heat conduction sheet.

13. A thermoelectric power generating timepiece according to claim 7, wherein an elastic member is disposed between said upper protection sheet and said heat conduction sheet.

14. A thermoelectric power generating timepiece according to claim 7, wherein a spacer is disposed between said upper protection sheet and said movement.

15. A thermoelectric power generating timepiece according to claim 14, wherein said spacer is made of a metallic material.

16. A thermoelectric power generating timepiece according to claim 7, wherein a first elastic member is disposed between said lower protection sheet and said case back, a second elastic member is disposed between said upper protection sheet and said movement, a third elastic member is disposed between said case and said heat conduction sheet, a fourth elastic member is disposed between said upper protection sheet and said heat conduction sheet, and a spacer is disposed between said upper protection sheet and said movement.

* * * * *